US008905294B2

(12) United States Patent
Younger et al.

(10) Patent No.: US 8,905,294 B2
(45) Date of Patent: Dec. 9, 2014

(54) PARTITIONED CONTAINER AND METHOD OF MAKING SAME

(75) Inventors: Scott D. Younger, Seattle, WA (US); John V. Heise, Federal Way, WA (US); Allen R. Tresch, Orting, WA (US)

(73) Assignee: Alliance Packaging, LLC, Renton, WA (US)

( * ) Notice: Subject to any disclaimer, the term of this patent is extended or adjusted under 35 U.S.C. 154(b) by 285 days.

(21) Appl. No.: 13/333,748

(22) Filed: Dec. 21, 2011

(65) Prior Publication Data

US 2012/0085815 A1 Apr. 12, 2012

Related U.S. Application Data

(63) Continuation of application No. 12/335,345, filed on Dec. 15, 2008, now Pat. No. 8,152,051.

(51) Int. Cl.
*B65D 5/49* (2006.01)
*B65D 25/04* (2006.01)

(52) U.S. Cl.
CPC ..... *B65D 5/48036* (2013.01)
USPC ..... 229/120.27; 229/120.26; 229/120.31

(58) Field of Classification Search
USPC ..... 229/120.24, 120.26, 120.27, 120.29, 229/120.31, 120.37, 120.38
See application file for complete search history.

(56) References Cited

U.S. PATENT DOCUMENTS

| | | | | |
|---|---|---|---|---|
| 2,719,650 | A | 10/1955 | Buttery et al. | 220/113 |
| 2,850,206 | A | 9/1958 | Pasjack | 220/105 |
| 2,943,762 | A | 7/1960 | Richardson | 220/105 |
| 2,943,763 | A | 7/1960 | Richardson | 220/115 |
| 3,065,876 | A | 11/1962 | Gioia | 220/105 |
| 3,070,276 | A | 12/1962 | Richardson | 229/15 |
| 3,184,142 | A | 5/1965 | Rosenburg, Jr. | 229/28 |
| 3,189,244 | A | 6/1965 | Whalen | 229/15 |
| 3,446,414 | A | 5/1969 | Omori | 229/28 |
| 3,478,947 | A | 11/1969 | Schillinger | |
| 3,575,286 | A | 4/1971 | Rosenburg, Jr. | 206/45.14 |
| 3,626,494 | A | 12/1971 | Levin | 229/15 |
| 3,640,445 | A | 2/1972 | Durham | 229/15 |
| 3,829,001 | A | 8/1974 | Wheeler | 229/15 |

(Continued)

FOREIGN PATENT DOCUMENTS

WO 01/76956 A1 10/2001

OTHER PUBLICATIONS

Revicart S.r.l., "Revicart Specialty Folder Gluers—Workable Box Dimensions," published at least as early as Sep. 2008, p. 14.

(Continued)

*Primary Examiner* — Gary Elkins
(74) *Attorney, Agent, or Firm* — Seed IP Law Group PLLC

(57) ABSTRACT

A partitioned container includes an outer case member erectable from a substantially flat condition to an expanded condition, and at least one partition formed from a unitary blank separate from the outer case member and configured to couple to at least one interior surface of the outer case member in the flat condition, the unitary blank including at least one divider panel and a plurality of cross members configured to automatically divide an interior of the outer case member into a plurality of cells when the outer case member is erected to the expanded condition. A partition blank for forming the partition member and a method of manufacturing a partitioned container are also provided.

10 Claims, 20 Drawing Sheets

(56) References Cited

U.S. PATENT DOCUMENTS

| | | | | |
|---|---|---|---|---|
| 3,829,003 | A | 8/1974 | Dilot | 229/31 R |
| 3,837,560 | A | 9/1974 | Kuchuris et al. | 229/15 |
| 3,921,891 | A | 11/1975 | Gorham | 229/15 |
| 3,963,169 | A | 6/1976 | Gardner | 229/28 R |
| 3,977,592 | A | 8/1976 | Gorham | 229/28 R |
| 3,980,223 | A | 9/1976 | Curran | 229/28 R |
| 3,982,684 | A | 9/1976 | David | 229/28 R |
| 3,997,102 | A | 12/1976 | Jones | 229/15 |
| 4,000,844 | A | 1/1977 | Weimer | 229/15 |
| 4,039,117 | A | 8/1977 | Sieffert | 229/15 |
| 4,096,984 | A | 6/1978 | Gardner | 229/15 |
| 4,108,348 | A | 8/1978 | Partain | 229/15 |
| 4,120,442 | A | 10/1978 | Skaggs | 229/15 |
| 4,130,235 | A | 12/1978 | Killy | 229/15 |
| 4,155,501 | A | 5/1979 | Young | 229/15 |
| 4,157,156 | A | 6/1979 | Skaggs | 229/15 |
| 4,157,157 | A | 6/1979 | Young | 229/28 R |
| 4,184,626 | A | 1/1980 | Graser et al. | 229/40 |
| 4,197,979 | A | 4/1980 | Dutcher | 229/29 D |
| 4,209,125 | A | 6/1980 | Helms | 229/15 |
| 4,219,148 | A | 8/1980 | Garmon | 229/28 R |
| 4,251,020 | A | 2/1981 | Schwaner | 229/15 |
| 4,293,091 | A | 10/1981 | Gerard | 229/27 |
| 4,294,398 | A | 10/1981 | Chidsey, Jr. | 229/15 |
| 4,299,351 | A | 11/1981 | Gardner | 229/42 |
| 4,333,600 | A | 6/1982 | Gardner | 229/42 |
| 4,335,842 | A | 6/1982 | Bradford et al. | 229/15 |
| 4,345,711 | A | 8/1982 | Fischer | 229/41 R |
| 4,376,507 | A | 3/1983 | Nauheimer | 229/15 |
| 4,376,508 | A | 3/1983 | Gardner et al. | 229/28 R |
| 4,396,146 | A | 8/1983 | Sieffert | 229/41 R |
| 4,406,365 | A | 9/1983 | Kulig | 206/188 |
| 4,413,769 | A | 11/1983 | Michetti | 229/27 |
| 4,417,684 | A | 11/1983 | Skaggs | 229/15 |
| 4,469,222 | A | 9/1984 | Graser | 206/180 |
| 4,470,539 | A | 9/1984 | Skillen | 229/28 BC |
| 4,477,016 | A | 10/1984 | Growney | 229/28 R |
| 4,541,560 | A | 9/1985 | Fischer | 229/27 |
| 4,583,677 | A | 4/1986 | Neese et al. | 229/15 |
| 4,632,300 | A | 12/1986 | Bartlett | 229/15 |
| 4,793,547 | A | 12/1988 | Lapoule et al. | 229/120.27 |
| 4,848,648 | A | 7/1989 | Eisman | 229/114 |
| 4,945,007 | A | 7/1990 | Coalier et al. | 428/542.8 |
| 4,955,502 | A | 9/1990 | Sorci | 220/22 |
| 5,209,393 | A | 5/1993 | Xapelli | 229/120.27 |
| 5,413,276 | A | 5/1995 | Sheffer | 229/120.11 |
| 5,465,834 | A | 11/1995 | Sieber et al. | 206/193 |
| 5,505,371 | A | 4/1996 | O'Neill | 229/120.26 |
| 5,529,240 | A | 6/1996 | Harris | 229/120.27 |
| 5,826,728 | A | 10/1998 | Sheffer | 206/774 |
| 5,941,377 | A | 8/1999 | Hart et al. | 206/175 |
| 5,971,265 | A | 10/1999 | Collins | 229/120.13 |
| 6,041,920 | A | 3/2000 | Hart et al. | 206/175 |
| 6,059,180 | A | 5/2000 | Collins | 229/120.13 |
| 6,336,556 | B1 | 1/2002 | Gale | 206/427 |
| 6,983,874 | B2 | 1/2006 | Bakx | 229/117.14 |
| 7,293,695 | B2 | 11/2007 | Stier | 229/120.14 |
| 8,152,051 | B2 * | 4/2012 | Younger et al. | 229/120.27 |
| 2005/0023281 | A1 | 2/2005 | Bradford | 220/528 |
| 2005/0230273 | A1 | 10/2005 | Kohler | 206/170 |
| 2005/0230463 | A1 | 10/2005 | Cain | 229/120.26 |
| 2012/0202665 | A1 | 8/2012 | Younger et al. | |

OTHER PUBLICATIONS

Partitioned box manufactured by Smurfit Kappa Parnalland, of Nuits St. Georges, France, for Les Vins Georges DuBoeuf S.A., of Romaneche Thorins, France, and sold within the US at least as early as Nov. 2008.

Office Action in U.S. Appl. No. 12/335,345 dated Jan. 21, 2011, 13 pages.

Final Office Action in U.S. Appl. No. 12/335,345 dated Sep. 1, 2011, 9 pages.

Office Action in U.S. Appl. No. 13/450,195, dated Feb. 21, 2013, 5 pages.

Final Office Action in U.S. Appl. No. 13/450,195, dated Jul. 10, 2013, 6 pages.

Office Action in U.S. Appl. No. 13/450,195, dated Aug. 5, 2014, 7 pages.

* cited by examiner

PARTITIONED CONTAINER AND METHOD OF MAKING SAME

CROSS-REFERENCE TO RELATED APPLICATIONS

This application is a continuation application of U.S. application Ser. No. 12/335,345 filed Dec. 15, 2008, which is incorporated herein by reference in its entirety.

BACKGROUND

1. Technical Field

This disclosure is generally related to containers, and more particularly, to partitioned containers having a plurality of cells for receiving, storing and/or transporting various articles, such as, for example, bottles.

2. Description of the Related Art

Containers, such as corrugated containers, having partition members to divide the containers into a number of cells or regions for receiving various articles, such as, for example, wine bottles and other packaged goods, have been in use for many years. For example, a partitioned container formed using a number of interlocking partition members and others like it, that require multiple folding and/or assembly steps prior to insertion into the container, are well known. Furthermore, these partitions typically extend completely from each side of the container to the other and fill an entire height of the container, thereby utilizing a relatively large amount of material to receive and separate articles.

Applicant believes that partitioned containers adapted to effectively receive and separate articles in a form factor or package having reduced material demands and enhanced assembly characteristics are desired.

BRIEF SUMMARY

A partitioned container particularly adapted to receive and separate articles in a form factor or package characterized by reduced material demands and enhanced assembly characteristics may be summarized as an erectable partitioned container having at least one unitary partition member attached to and enclosed within a conventional outer case blank in a flat condition such that, when the outer case blank is erected in a conventional manner, the at least one partition member automatically erects or expands to form a plurality of cells for receiving and separating various articles. This is particularly advantageous in reducing the time required to assemble or form partitioned containers at or near a point of use. Furthermore, because the partition member is attachable to the outer case blank in a flat condition, further efficiencies are gained by reducing the need to pre-assemble the partition member prior to attachment to the outer case blank. Although the size, shape and number of the formed cells may vary, various embodiments of the present invention are particularly adapted to form six or twelve substantially equal cells for receiving and separating articles of like kind, such as, for example, wine bottles. To reduce the amount of material required to partition such articles, the at least one partition member has, in some embodiments, a height less than the height of the partitioned container and a partitioning surface area less than a primary side surface of the partitioned container. In this manner, a particularly environmentally friendly partitioned container is formed.

According to one embodiment, a partitioned container comprises an outer case member erectable from a substantially flat condition to an expanded condition, and a first partition formed from a unitary blank separate from the outer case member and configured to couple to at least one interior surface of the outer case member in the flat condition, the unitary blank including at least one divider panel and a plurality of cross members configured to automatically divide an interior of the outer case member into a plurality of cells when the outer case member is erected to the expanded condition.

According to another embodiment, an erectable partition blank for partitioning a container comprises a divider panel having at least a divider panel contact region for coupling the divider panel to a first interior surface of an outer case blank, the outer case blank being adapted to erect to form an outer case of the container, and a plurality of cross members integral to the divider panel, each cross member having a cross member contact region for coupling one or more of the plurality of cross members to at least a second interior surface of the outer case blank, and wherein the partition blank is configured to erect with the outer case blank from a substantially flat condition to an expanded condition in which the cross members of the partition blank extend substantially perpendicular to the divider panel to divide an interior of the outer case into a plurality of cells.

According to another embodiment, a method for forming an erectable partitioned container comprises forming a unitary partition blank to include a plurality of cross members and one or more divider panels, each cross member hinged to the one or more divider panels for rotation to an erected configuration, coupling a contact region of at least one of the plurality of cross members of the unitary partition blank to an interior surface of an outer case blank, and folding the outer case blank about a first fold line and a second fold line to couple an end of the outer case blank to a flap of the outer case blank to thereby form an erectable container structure in a flat configuration, the erectable container structure substantially enclosing the unitary partition blank and being configured to automatically rotate the plurality of cross members of the unitary partition blank to the erected configuration when the erectable container structure is erected to form a partitioned container.

BRIEF DESCRIPTION OF THE SEVERAL VIEWS OF THE DRAWINGS

FIG. 3B is a plan view of the outer case blank and partition blank of FIG. 3A folded about line a.

FIG. 8B is a plan view of the outer case blank and partition blank of FIG. 8A folded about line a.

FIG. 12B is a plan view of the outer case blank and partition blanks of FIG. 12A folded about line a.

FIG. 16B is a plan view of the outer case blank and partition blanks of FIG. 16A folded about line a.

FIG. 21B is a plan view of the outer case blank and partition blank of FIG. 21A folded about line a.

FIG. 26B is a plan view of the outer case blank and partition blanks of FIG. 26A folded about line a.

DETAILED DESCRIPTION

Figure 1:
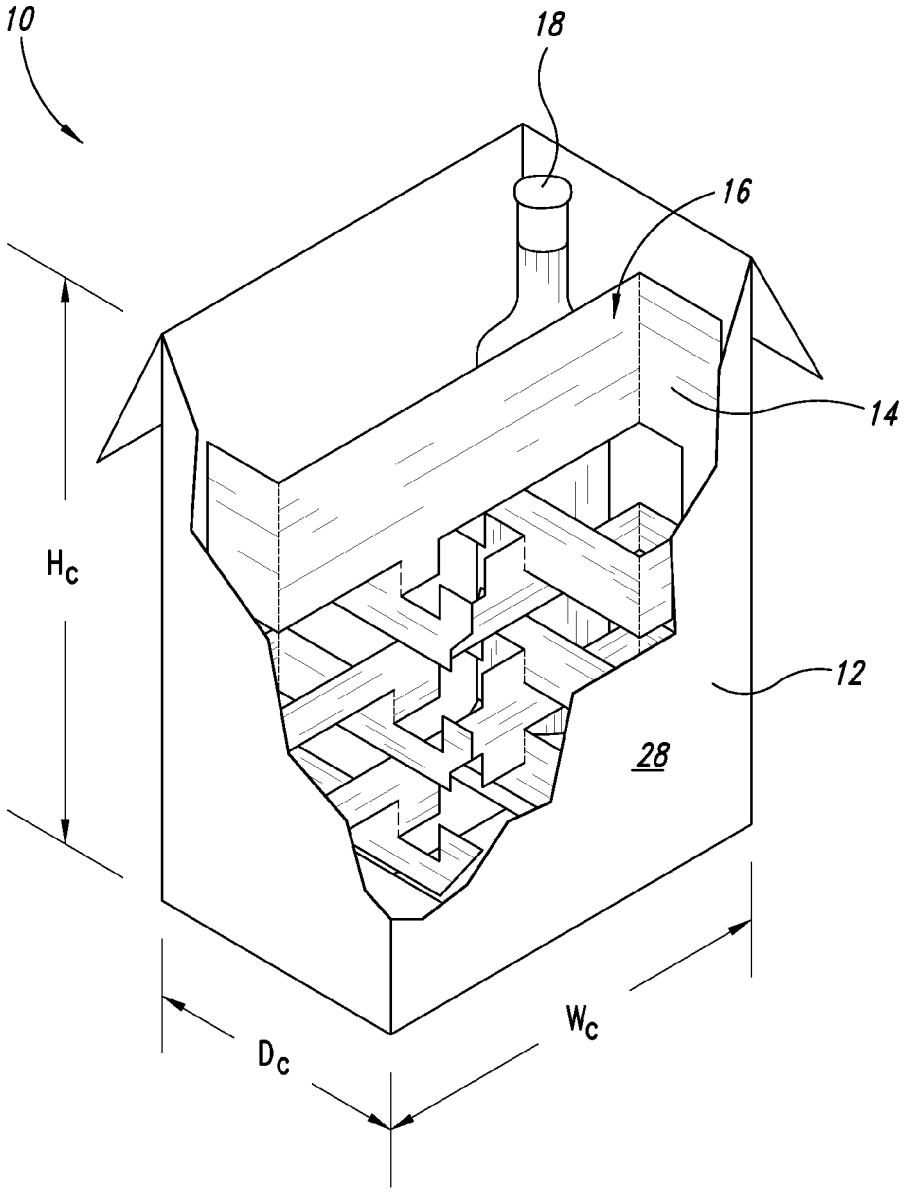
FIG. 1 is a partially cut-away perspective view of a partitioned container according to one embodiment.

FIG. 1 illustrates one embodiment of a partitioned container 10 having an interior volume defined by a container height Hc, width We and depth Dc. The partitioned container 10 includes an outer case member 12 and a partition member 14, the partition member 14 dividing the interior of the container 10 into a plurality of cells 16 to receive and separate various articles 18, such as, for example, wine bottles. The cells 16 of the partitioned container 10 are aligned in a number of rows and columns, such as, for example, two rows and three columns as shown. Although the cells 16 of the container 10 are preferably substantially equal to receive articles 18 of like kind, the cells may vary in size and shape from each other and may vary in number.

The partition member 14 is adapted to attach to the outer case member 12 of the partitioned container 10 in a completely flat condition and to erect or expand to the condition shown in FIG. 1 when the outer case member 12 (formed from a conventional outer case blank) is erected in a manner well known in the art. Accordingly, the partition member 14 is automatically and simultaneously erected with the outer case member 12 to partition the container 10 into a plurality of cells 16. Because the partition member 14 and outer case member 12 erect simultaneously, the partition member 14 and outer case member 12 may be shipped together in a substantially flat condition to a filling location for subsequent erection and filling. This is particularly advantageous in reducing the time required to assemble or form partitioned containers at or near a point of use. Furthermore, because the partition member 14 is attachable to the outer case member 12 in a completely flat condition, further efficiencies are gained by reducing the need to fold and/or pre-assemble the partition member 14, as is typical of conventional partition members, prior to attachment to the outer case member 12.

Moreover, the illustrated partition member 14 is particularly adapted to receive and separate articles in a form factor or package having reduced material demands. In particular, the partition member 14 of the illustrated embodiment has a height less than the height Hc of the partitioned container 10 and is formed from a unitary partition blank having a partitioning surface area less than is typical of conventional partition members used to partition a similarly dimensioned container. In particular, in some embodiments, the partition member 14 has a partitioning surface effective in partitioning a container into six substantially equal cells 16 with a surface area less than a primary side surface 28 of the partitioned container 10—the primary side surface 28 being the larger of the side surfaces of the container 10 with an area defined by the container height Hc and container width Wc. As such, the partition member 14 is characterized by significant reductions in material costs and also provides effective partitioning in an environmentally friendly manner.

Figure 2:
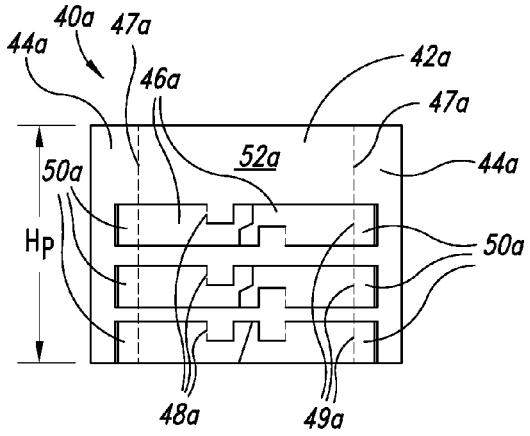
FIG. 2 is a plan view of a partition blank for forming a partition member according to one embodiment.

FIGS. 2 through 5, illustrate one embodiment of a partitioned container 10*a* particularly adapted to receive and separate articles in a form factor or package having reduced material demands and enhanced assembly characteristics. As illustrated in FIG. 2, a partition member for partitioning the container is formed from a unitary partition blank 40*a*. The blank 40*a* is preferably made of a single piece of paperboard and formed via a diecutting process, however, those skilled in the art will appreciate that other materials and manufacturing methods may be used to form the partition blank of the present embodiment and various other embodiments described herein.

The unitary partition blank 40*a* of the illustrated embodiment includes a divider panel 42*a* located between two divider panel contact regions 44*a*, the divider panel contact regions 44*a* being adapted to attach the divider panel 42*a* to interior surfaces of an outer case of the partitioned container, preferably via adhesive or glue. It will be understood, however, that other attachment means, such as, for example, stapling may be used. Each of the divider panel contact regions 44*a* are rotatably connected to the divider panel 42*a* about divider panel rotation axes 47*a* for rotation from a flat condition (as shown in FIG. 2) to an erected or expanded condition in which the divider panel 42*a* is substantially perpendicular to the divider panel contact regions 44*a*. In the erected or expanded condition, the divider panel 42*a* divides the container into a number of rows while the divider panel contact regions 44*a* secure the divider panel 42*a* to side panels of the partitioned container.

The unitary partition blank 40*a* further includes a plurality of cross members 46*a*, wherein each cross member 46*a* is rotatably connected to a cross member contact region 50*a* for relative rotation therebetween about a contact region rotation axis 49*a*. Each cross member 46*a* is also rotatably connected to the divider panel 42*a* for rotation about a cross member rotation axis 48*a* from a flat condition (as shown in FIG. 2) to an erected or expanded condition. As cross members 46*a* transition from the flat condition to the erected or expanded condition, the cross members 46*a* rotate relative to both the divider panel 42*a* (about cross member rotation axes 48*a*) and cross member contact regions 50*a* (about contact region rotation axes 49*a*) to subdivide the rows created by the divider panel 42*a* into a plurality of cells for receiving and separating various articles. The cross member contact regions 50*a* are adapted to couple to interior surfaces of the container via glue or otherwise, thereby securing ends of the cross members 46*a* to side panels 22*a* of the partitioned container.

Rotation of cross members 46*a* relative to the cross member contact regions 50*a* and relative to the divider panel 42*a*, as well as rotation of the divider panel 42*a* relative to the divider panel contact regions 44*a*, may be assisted by perforating, creasing, and/or scoring the partition blank 40*a* about each of the rotation axes 47*a*, 48*a*, 49*a*, as illustrated by broken lines in FIG. 2. In contrast, solid lines indicate where the partition blank 40*a* is cut or pierced through an entire thickness of the partition blank 40*a*. For example, apart from the cross member rotation axes 48*a*, the outer profile or contour of each cross member 46*a* and corresponding cross member contact region 50*a* is completely separated from surrounding material of the partition blank 40*a*.

The unitary partition blank 40*a* has a partition surface 52*a* divided into contacting regions defined by those areas that are adapted to contact a surface of the container to be partitioned (i.e., the divider panel contact regions 44*a* and the cross member contact regions 50*a*) and partitioning regions defined by those areas that are not adapted to contact the surface of the container (i.e., the divider panel 42*a* and cross members 46*a*) when the container is erected. The partitioning regions of the partition surface 52*a* (i.e., the partition surface 52*a* less all contact regions) form an area which is equal to or less than an area of a primary side surface 28*a* of the container to be partitioned—the primary side surface 28*a* (with reference to FIG. 4) being the larger of the side surfaces of the container with an area defined by the container height Hc and container width Wc. In this manner, the partition is particularly suited for effectively dividing a container with a minimal amount of material. For example, for a partitioned container with a height Hc of approximately 12 inches, width Wc of approximately 9 inches, and a depth Dc of approximately 6, the partitioning regions of the partition surface 52*a* for partitioning the container into six cells has an area less than 108 square inches (Wc·Hc). Conversely, a conventional partition of comparable height having partition members spanning the full width Wc and depth Dc of the container would require at least 252 square inches of material (2·Dc·Hc+Wc·Hc) or approximately two and one-third times more material for partitioning a similarly dimensioned container. As such, the present invention results in reduced material costs and a more environmentally friendly partitioned container.

In some embodiments, a height Hp of the partition blank 40*a* may be less than the height Hc of the container to be formed. Reducing the height Hp of the partition blank 40*a* leads to further reductions in the amount of material used to effectively partition a container and is therefore particularly advantageous for environmental impact reasons, as well as for reducing material costs.

Figure 3A:
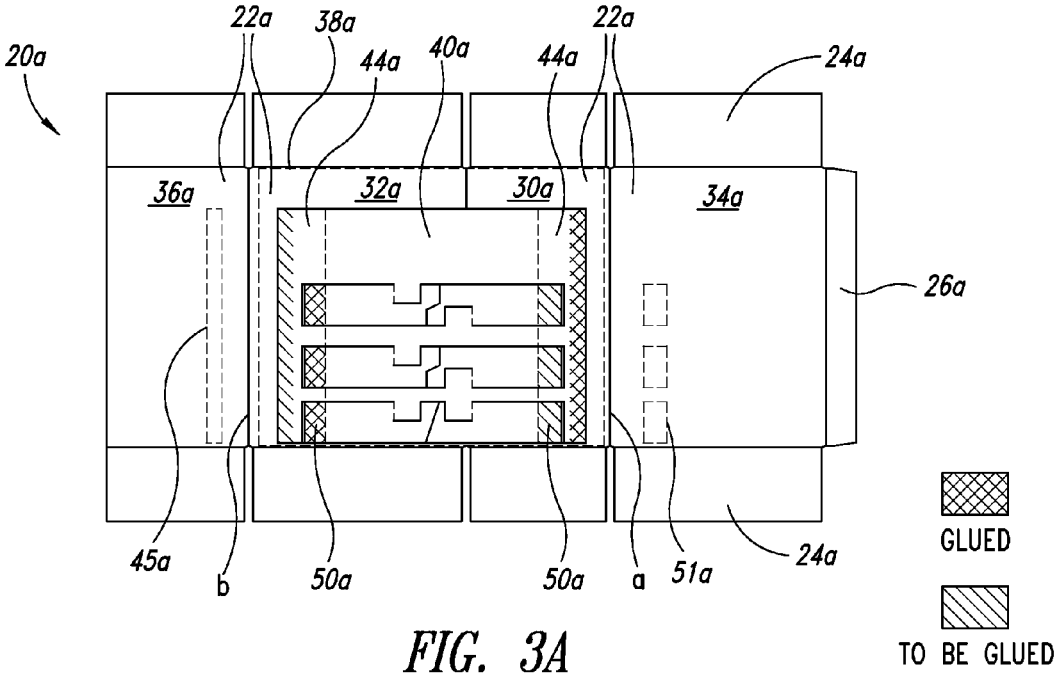
FIG. 3A is a plan view of an outer case blank for forming an outer case member with the partition blank of FIG. 2 attached thereto.
Figure 3B:
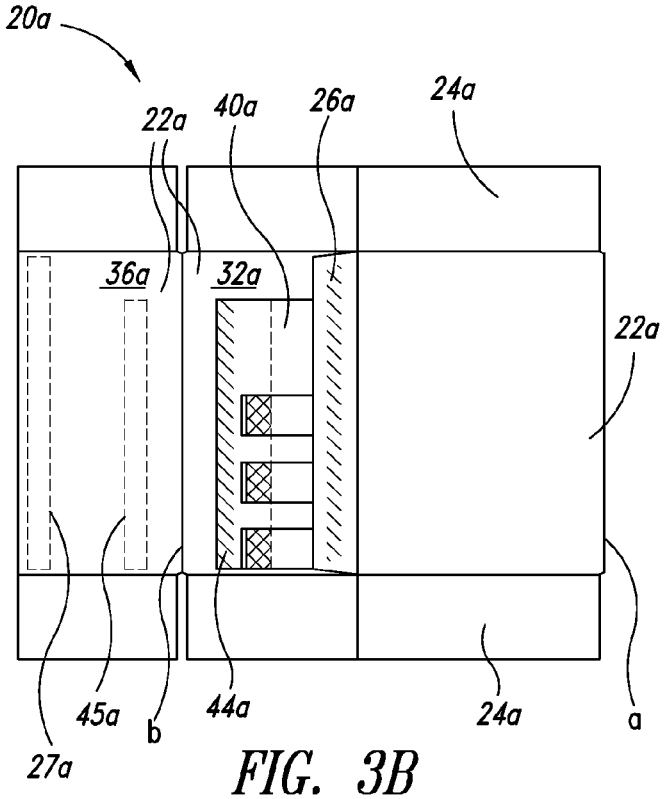
Figure 3C:
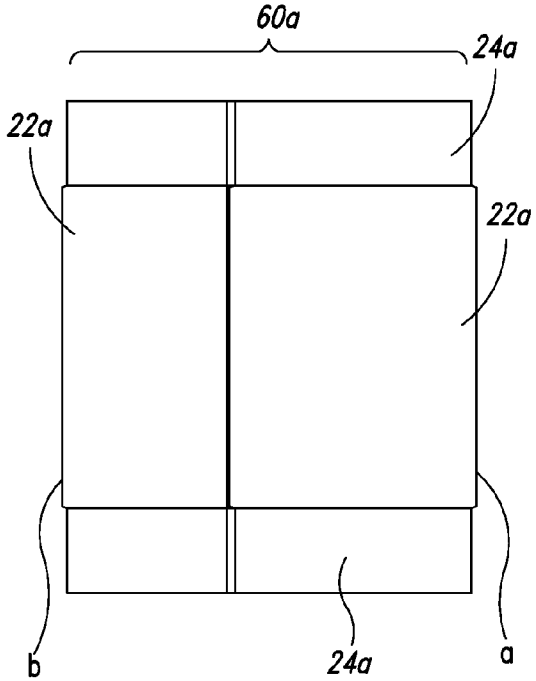
FIG. 3C is a plan view of the outer case blank and partition blank of FIG. 3A folded about line a and line b.

With reference to FIGS. 3A-C, the partition blank 40*a* is configured to attach to an outer case blank 20*a*, the outer case blank 20*a* comprising a conventional configuration including side panels 22*a*, top and bottom flaps 24*a* and a glue flap 26*a*. Although a conventional outer case blank 20*a* in the form of a Regular Slotted Case (RSC) blank is illustrated, those skilled in the art will appreciate that other outer case blank styles, such as, for example, a Half Slotted Case (HSC) blank or an All Flaps Meet (AFM) blank, may be used with the present embodiment and various other embodiments described herein.

Although the partition blank 40*a* may be attached to various side panels 22*a* in a number of different ways, the partition blank 40*a* is preferably attached to the outer case blank 20*a* within a partition receiving zone 38*a* located within the combined area of two adjacent interior side surfaces 30*a*, 32*a* of the side panels 22*a* of the outer case blank 20*a*. The partition blank 40*a* is configured to attach to a first side surface 30*a* of the outer case blank 20*a* via one of the divider panel contact regions 44*a* and is configured to attach to a second side surface 32*a* via a number of the cross member contact regions 50*a*. The partition blank 40*a* is preferably attached to the outer case blank 20*a* with an adhesive or glue, however, other attachment means, such as, for example, stapling may be used.

With the partition blank 40*a* in the partition receiving zone 38*a*, the outer case blank 20*a* may be folded about fold line a (FIG. 3B) and fold line b (FIG. 3C) to substantially enclose the partition blank 40*a* therein. When folding the outer case blank 20*a* in this manner, the partition blank 40*a* is further attached to a third side surface 34*a* and a fourth side surface 36*a* of the outer case blank 20*a*. A first set of broken lines 51*a* in FIG. 3A illustrate where the third side surface 34*a* contacts other cross member contact regions 50*a* of the partition blank 40*a* and a second set of broken lines 45*a* illustrate where the fourth side surface 36*a* contacts the other divider panel contact region 44*a*. Again, the partition blank 40*a* is preferably attached to the outer case blank 20*a* with adhesive or glue. End side panels of the outer case blank 20*a* are secured together, preferably glued, via glue flap 26*a* as indicated by broken lines 27*a* in FIG. 3B to complete an erectable container structure 60*a* that is configured to erect or expand from a flat condition, wherein the partition blank 40*a* remains substantially flat, to an expanded condition, wherein the partition blank 40*a* is erected to create partitioned cells. In other words, the partition blank 40*a* is automatically and simultaneously erected with the outer case to partition the formed container into a plurality of cells.

It will be appreciated by those skilled in the art that the completed erectable container structure 60*a* described above, as well as other erectable container structures described hereinafter, may be formed via a single pass of an outer case blank 20*a* and one or more respective partition blanks 40*a* through a machine designed to perform both gluing and folding, sometimes referred to as "folder-gluers." In this manner, numerous erectable container structures 60*a* may be formed rapidly and efficiently, each erectable container structure 60*a* being formed in a flat condition for subsequent shipment to a filling location.

Figure 4:
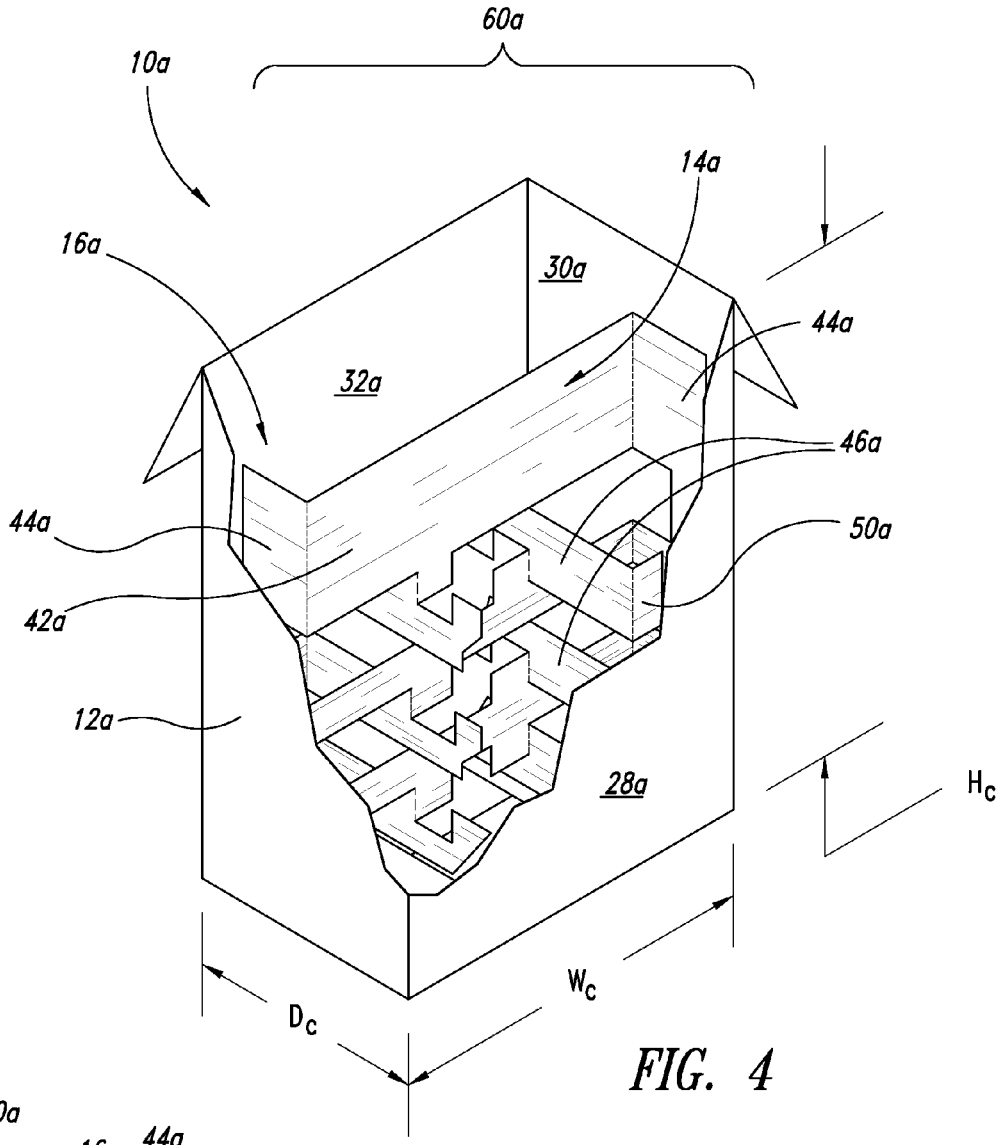
FIG. 4 is a partially cut-away perspective view of the outer case blank and partition blank of FIG. 3C in an expanded condition.
Figure 5:
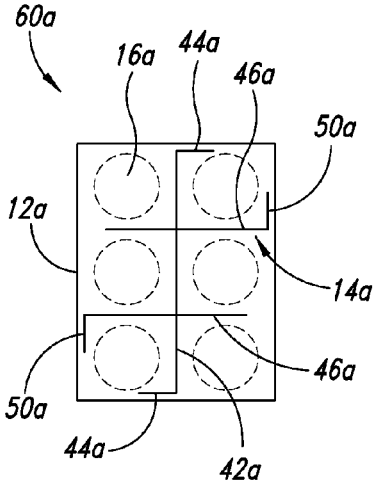
FIG. 5 is a top schematic view of the outer case blank and partition blank of FIG. 3C in an expanded condition.

FIGS. 4 and 5 illustrate the erectable container structure 60*a* in the expanded condition with the partition 14*a* shown dividing the outer case 12*a* into six cells 16*a* to receive and effectively separate various articles. As shown, the cross members 46*a* attach to an interior surface of the outer case 12*a* and extend across the divider panel 42*a* and terminate between the divider panel 42*a* and an opposing interior surface of the outer case 12*a*. In this manner, end portions of the cross members 46*a* extend partially across the depth Dc of the container to form the cells 16*a* and to prevent contact between adjacent articles in a reduced form that requires relatively less material than would otherwise be required of cross members that extend entirely from one side surface of the container to the other.

Although the illustrated embodiment includes six cross members 46*a*, more or fewer cross members 46*a* may be used to partition the container 10*a*. For example, two cross members may be used to partition the container 10*a* into six cells. In addition, cross members 46*a* may be selectively located throughout the height Hc of the partitioned container 10*a* and may vary in size and shape to separate articles of various profiles and/or protect different areas on such articles, such as, for example, labels of a wine bottle.

Figure 6:
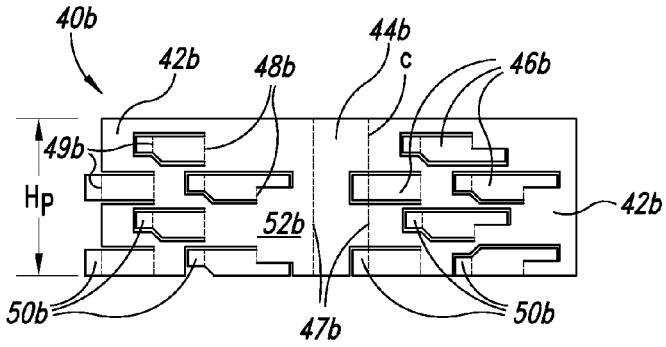
FIG. 6 is a plan view of a partition blank for forming a partition member according to one embodiment.

FIGS. 6 through 10 illustrate another embodiment of a partitioned container 10*b* for receiving and separating articles. As illustrated in FIG. 6, a partition member for partitioning the container is formed from a unitary partition blank 40*b* preferably diecut from a single piece of paperboard having two divider panels 42*b* separated by a single divider panel contact region 44*b*. The divider panel contact region 44*b* is also adapted to attach the divider panels 42*b* to an interior surface of an outer case of the partitioned container, preferably via adhesive or glue. The divider panel contact region 44*b* is rotatably connected to the divider panels 42*b* about two separate divider panel rotation axes 47*b* for rotation from a flat condition (as shown in FIG. 6) to an erected or expanded condition in which each divider panel 42*b* is substantially perpendicular to the divider panel contact region 44*b*. Thus, in the erected or expanded condition, the divider panels 42*b* (each divider panel 42*b* parallel and offset from the other) divide the container into a number of rows while the divider panel contact region 44*b* secures the divider panels 42*b* to a side panel of the container.

The unitary partition blank 40*b* further includes a plurality of cross members 46*b*, wherein each cross member 46*b* is rotatably connected to a cross member contact region 50*b* for relative rotation therebetween about a contact region rotation axis 49*b*. Each cross member 46*b* is also rotatably connected to one of the divider panels 42*b* for rotation about a cross member rotation axis 48*b* from a flat condition (as shown in FIG. 6) to an erected or expanded condition. As cross members 46*b* transition from the flat condition to the erected or expanded condition, the cross members 46*b* rotate relative to the divider panels 42*b* (about cross member rotation axes 48*b*) and the cross member contact regions 50*b* (about contact region rotation axes 49*b*) to subdivide rows created by the divider panels 42*b* into a plurality of cells for receiving and separating various articles. The cross member contact regions 50*b* are adapted to couple to interior surfaces of the container via glue or otherwise, thereby securing ends of the cross members 46*b* to side panels 22*b* of the partitioned container.

Similar to the earlier discussion, rotation of cross members 46*b* relative to the cross member contact regions 50*b* and relative to the divider panels 42*b*, as well as rotation of the divider panels 42*b* relative to the divider panel contact region 44*b*, may be assisted by perforating, creasing, and/or scoring the partition blank 40*b* about each of the rotation axes 47*b*, 48*b*, 49*b*, as illustrated by broken lines. In contrast, solid lines indicate where the partition blank 40*b* is cut or pierced through an entire thickness of the partition blank 40*b*. For example, apart from the cross member rotation axes 48*b*, the outer profile or contour of each cross member 46*b* and corresponding cross member contact region 50*b* is completely separated from surrounding material of the partition blank 40*b*.

With continued reference to FIG. 6, the unitary partition blank 40*b* has a partition surface 52*b* divided into contacting regions defined by those areas that are adapted to contact a surface of the container to be partitioned (i.e., the divider panel contact region 44*b* and the cross member contact regions 50*b*) and partitioning regions defined by those areas that are not adapted to contact the surface of the container (i.e., the divider panels 42*b* and the cross members 46*b*) when the container is erected. The partitioning regions of the partition surface 52*b* form an area which is equal to or less than twice an area of a primary side surface 28*b* (with reference to FIG. 9) of the container to be formed, and thus form an efficient partitioning structure in terms of material utilization. For example, for a partitioned container with a height Hc of approximately 12 inches, a width Wc of approximately 12 inches, and a depth Dc of approximately 9, the partitioning regions of the partition surface 52*b* for partitioning the container into twelve cells has an area less than 288 square inches (2·Wc·Hc). Conversely, a conventional partition of comparable height having partition members spanning the full width Wc and depth Dc of the container would require at least 504 square inches of material (2·Dc·Hc+2·Wc·Hc) or approximately one and three-quarter times more material for partitioning a similarly dimensioned container. As such, the present invention results in reduced material costs and a more environmentally friendly partitioned container.

In some embodiments, a height Hp of the partition blank 40*b* may be less than the height Hc of the container to be partitioned. Reducing the height Hp of the partition blank 40*b* leads to further reductions in the amount of material used to effectively partition a container and is therefore particularly advantageous for environmental impact reasons, as well as for reducing material costs.

Figure 7:
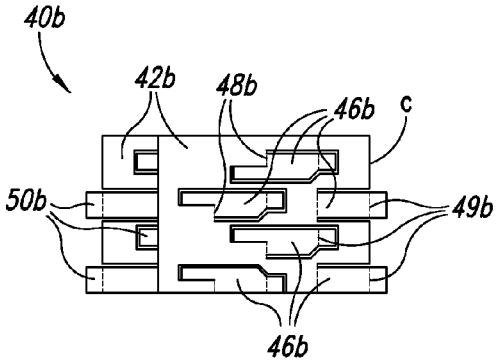
FIG. 7 is a plan view of the partition blank of FIG. 6 in a folded condition.
Figure 8A:
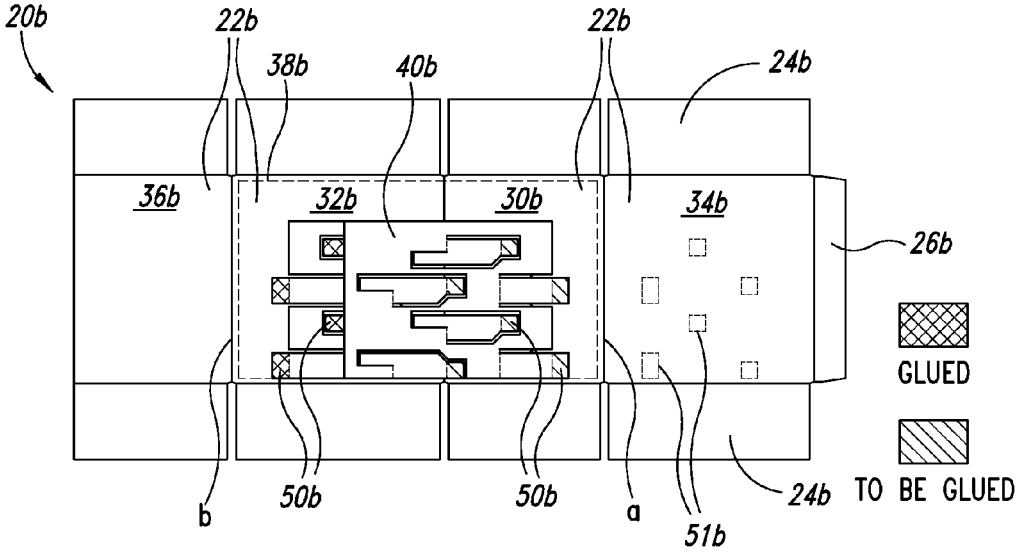
FIG. 8A is a plan view of an outer case blank for forming an outer case member with the folded partition blank of FIG. 7 attached thereto.

According to this illustrated embodiment, the partition blank 40*b* is foldable about fold line c from an entirely flat condition (FIG. 6) to a substantially flat folded condition (FIG. 7). As shown in FIG. 8A, the partition blank 40*b* is configured to attach to an outer case blank 20*b* (the outer case blank comprising a conventional configuration including side panels 22*b*, top and bottom flaps 24*b* and a glue flap 26*b*) in the folded flat condition preferably within partition receiving zone 38*b*, the partition receiving zone 38*b* being located within the combined area of two adjacent interior side surfaces 30*b*, 32*b* of the outer case blank 20*b*. In this embodiment, the folded partition blank 40*b* is configured to attach to the first side surface 30*b* of the outer case blank 20*b* via the divider panel contact region 44*b* and is configured to attach to the second side surface 32*b* via a number of the cross member contact regions 50*b*, the partition blank 40*b* preferably being attached via adhesive or glue.

Figure 8B:
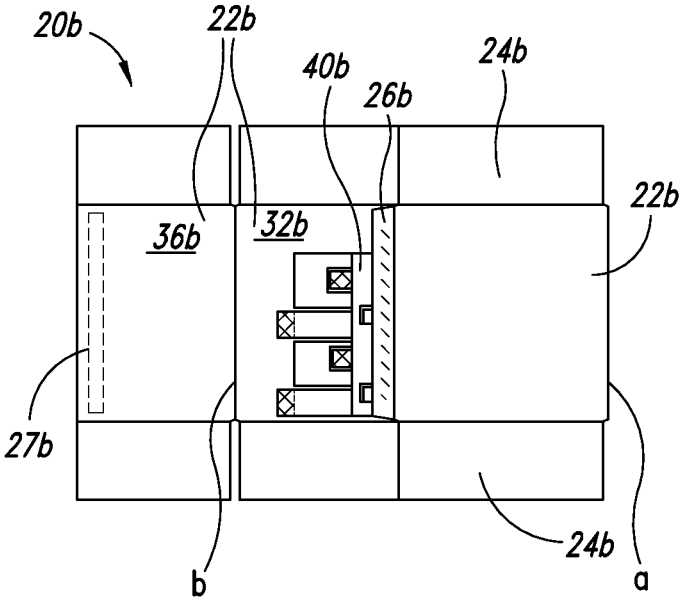
Figure 8C:
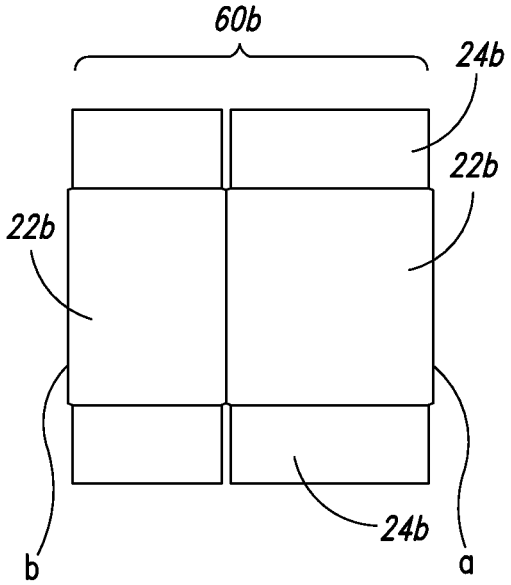
FIG. 8C is a plan view of the outer case blank and partition blank of FIG. 8A folded about line a and line b.

As illustrated in FIGS. 8A-8C, with the partition blank 40*b* in the partition receiving zone 38*b*, the outer case blank 20*b* may be folded about fold line a (FIG. 8B) and fold line b (FIG. 8C) to substantially enclose the partition blank 40*b* therein. When folding the outer case blank 20*b* in this manner, the partition blank 40*b* is attached, preferably via adhesive or glue, to a third side surface 34*b* of the outer case blank 20*b*. Broken lines 51*b* in FIG. 8A illustrate where the third side surface 34*b* contacts other cross member contact regions 50*b* of the partition blank 40*b*. End side panels of the outer case blank 20*b* are secured together, preferably glued, via glue flap 26*b* as indicated by broken lines 27*b* in FIG. 8B to complete an erectable container structure 60*b* that is configured to erect or expand from a flat condition, wherein the partition blank 40*b* remains substantially flat, to an expanded condition, wherein the partition blank 40*b* is erected to create partitioned cells. In other words, the partition blank 40*b* is automatically and simultaneously erected with the outer case to partition the formed container into a plurality of cells.

Figure 9:
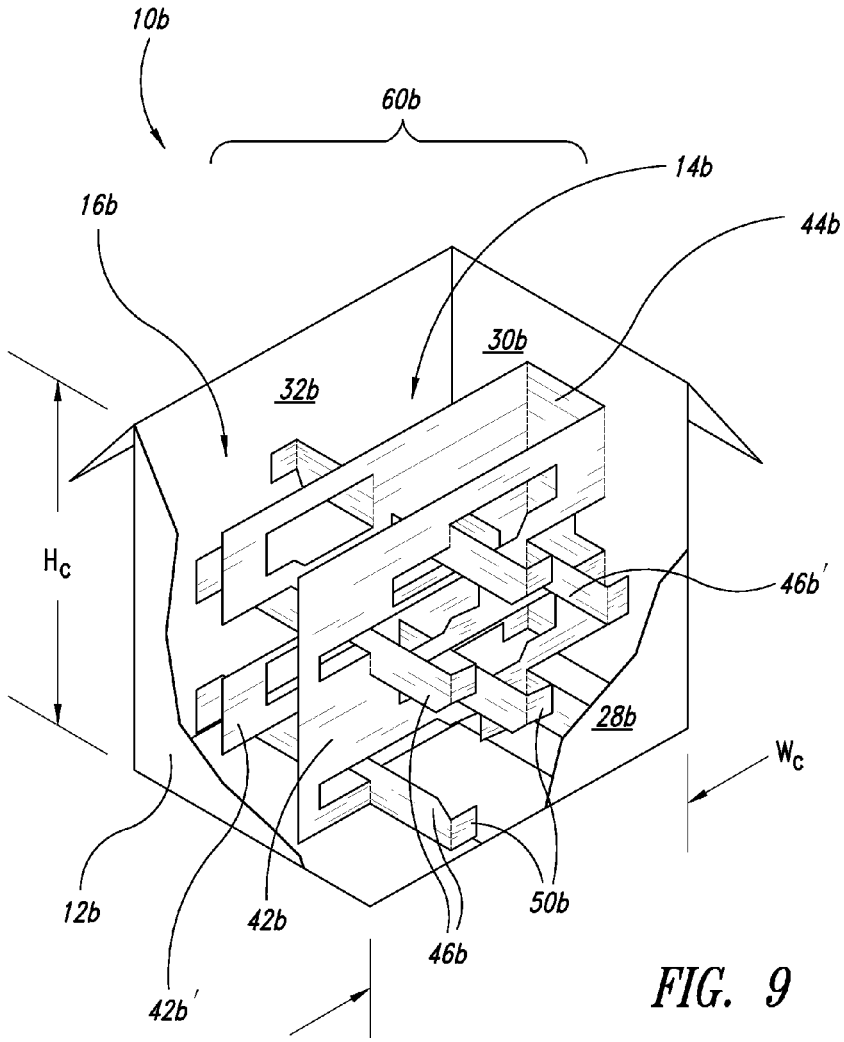
FIG. 9 is a partially cut-away perspective view of the outer case blank and partition blank of FIG. 8C in an expanded condition.
Figure 10:
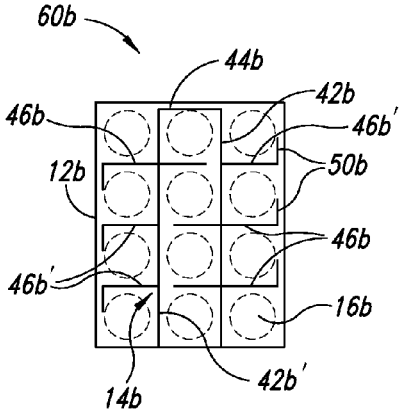
FIG. 10 is a top schematic view of the outer case blank and partition blank of FIG. 8C in an expanded condition.

FIGS. 9 and 10 illustrate the erectable container structure 60*b* in the expanded condition, wherein the partition 14*b* is shown dividing the outer case 12*b* into twelve cells 16*b*. As shown, at least some of the cross members 46*b* attach to an interior surface of the outer case 12*b*, extend across a first divider panel 42*b* and terminate between the first divider panel 42*b* and the second divider panel 42*b*'. In this manner, end portions of a number of the cross members 46*b* extend partially across the space between the divider panels 42*b*, 42*b*' to form some of the cells 16*b* and to prevent contact between adjacent articles in a reduced form that requires relatively less material than would otherwise be required of cross members that extend completely between divider panels. Other cross members 46*b*' attach to an interior surface of the outer case 12*b* and extend to and terminate at the divider panels 42*b*, 42*b*'.

Although the illustrated embodiment includes twelve cross members 46*b*, 46*b*', more or fewer cross members 46*b*, 46*b*' may be used to partition the container 10*b*. For example, six cross members 46*b*, 46*b*' may be used to partition the container 10*b* into twelve cells. As in other previously described embodiments, the cross members 46*b*, 46*b*' may be selectively located throughout the height Hc of the partitioned container and may vary in size and shape to separate articles of various profiles and/or to protect different areas on such articles.

Figure 11:
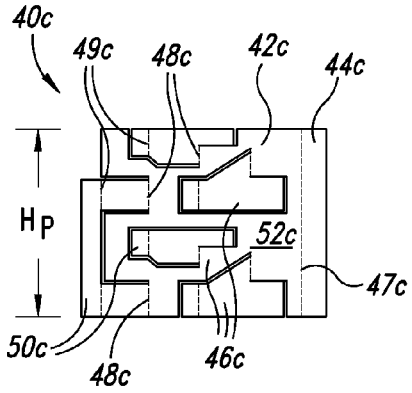
FIG. 11 is a plan view of a partition blank for forming a partition member according to one embodiment.

FIGS. 11 through 14 illustrate yet another embodiment of a partitioned container 10*c* for receiving and separating articles. As illustrated in FIG. 11, a first or primary partition member for partitioning the container is formed from a first or primary unitary partition blank 40*c* preferably diecut from a single piece of paperboard having a divider panel 42*c* and a divider panel contact region 44*c*. The divider panel contact region 44*c* is adapted to attach the divider panel 42*c* to an interior surface of an outer case of the partitioned container, preferably via adhesive or glue. The divider panel contact region 44*c* is also rotatably connected to the divider panel 42*c* about a divider panel rotation axis 47*c* for rotation from a flat condition (as shown in FIG. 11) to an erected or expanded condition in which the divider panel 42*c* is substantially perpendicular to the divider panel contact region 44*c*. Thus, in the erected or expanded condition, the divider panel 42*c* divides the container into a number of rows while the divider panel contact region 44*c* secures the divider panel 42*c* to a side panel of the container.

The first or primary unitary partition blank 40*c* further includes a plurality of cross members 46*c*, wherein each cross member 46*c* is rotatably connected to a cross member contact region 50*c* for relative rotation therebetween about a contact region rotation axis 49*c*. Each cross member 46*c* is also rotatably connected to the divider panel 42*c* for rotation about a cross member rotation axis 48*c* from a flat condition (as shown in FIG. 11) to an erected or expanded condition. As the cross members 46*c* transition from the flat condition to the erected or expanded condition, the cross members 46*c* rotate relative to the divider panel 42*c* (about cross member rotation axes 48*c*) and the cross member contact regions 50*c* (about contact region rotation axes 49*c*) to subdivide at least one row created by the divider panel 42*c* into a plurality of cells for receiving and separating various articles. The cross member contact regions 50*c* are adapted to couple to an interior surface of the container via glue or otherwise, thereby securing ends of the cross members 46*c* to a side panel 22*c* of the partitioned container.

Similar to the earlier discussion, rotation of cross members 46*c* relative to the cross member contact regions 50*c* and relative to the divider panel 42*c*, as well as rotation of the divider panel 42*c* relative to the divider panel contact region 44*c*, may be assisted by perforating, creasing, and/or scoring the partition blank 40*c* about each of the rotation axes 47*c*, 48*c*, 49*c*, as illustrated by broken lines in FIG. 11. In contrast, solid lines indicate where the partition blank 40*c* is cut or pierced through an entire thickness of the partition blank 40*c*. For example, apart from the cross member rotation axes 48*c*, the outer profile or contour of each cross member 46*c* and corresponding cross member contact region 50*c* is completely separated from surrounding material of the partition blank 40*c*.

With reference to FIG. 11, the first or primary partition blank 40*c* has a partition surface 52*c* divided into contacting regions defined by those areas that are adapted to contact a surface of the container to be partitioned (i.e., the divider panel contact region 44*c* and the cross member contact regions 50*c*) and partitioning regions defined by those areas that are not adapted to contact the surface of the container (i.e., the divider panel 42*c* and the cross members 46*c*) when the container is erected. The partitioning regions of the partition surface 52*c* of the first or primary partition blank 40*c* form an area which is equal to or less than an area of a primary side surface 28*c* (with reference to FIG. 13) of the container to be formed, and thus form an efficient partitioning structure in terms of material utilization.

In some embodiments, a height Hp of the first or primary partition blank 40*c* is less than the height Hc of the container to be partitioned. Reducing the height Hp of the partition blank 40*c* leads to further reductions in the amount of material used to effectively partition a container and is therefore particularly advantageous for environmental impact reasons, as well as for reducing material costs.

Figure 12A:
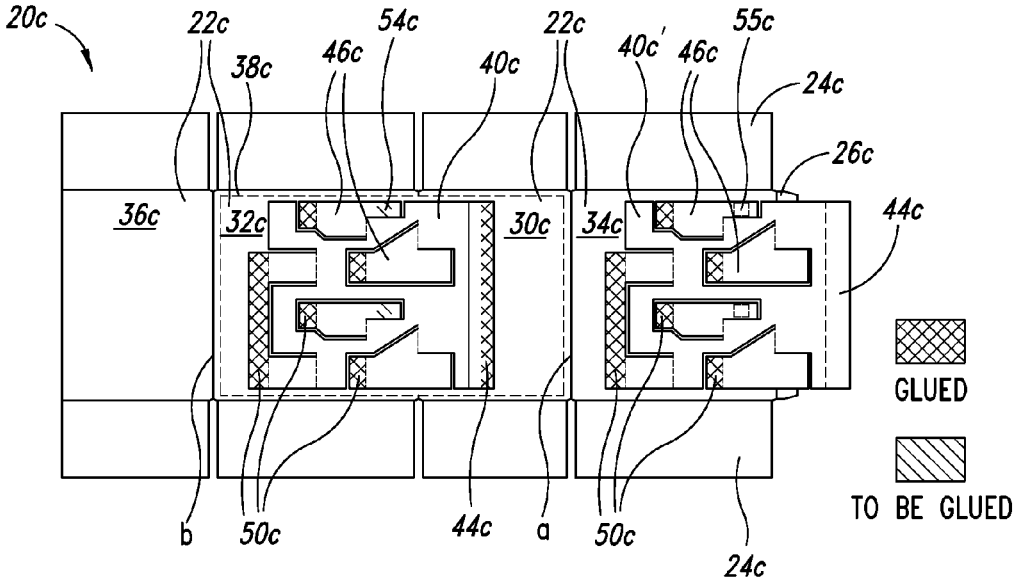
FIG. 12A is a plan view of an outer case blank for forming an outer case member with two partition blanks of FIG. 11 attached thereto.
Figure 12B:
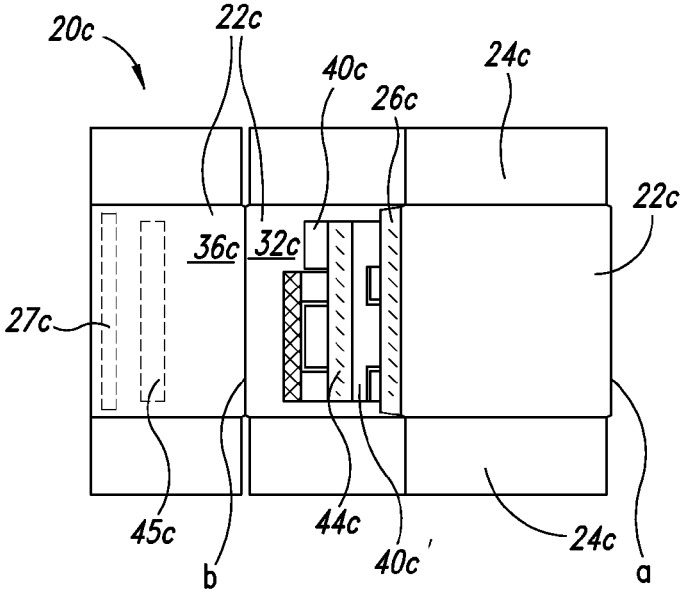
Figure 12C:
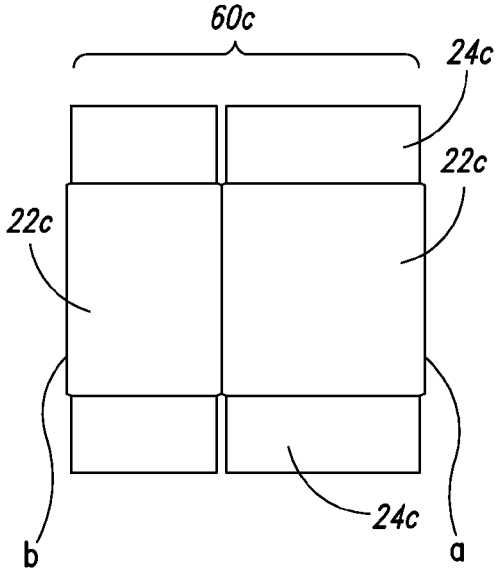
FIG. 12C is a plan view of the outer case blank and partition blanks of FIG. 12A folded about line a and line b.

With reference to FIGS. 12A-C, the first or primary partition blank 40*c* is configured to attach to an outer case blank 20*c* (the outer case blank 20*c* comprising a conventional configuration including side panels 22*c*, top and bottom flaps 24*c* and a glue flap 26*c*) preferably within a partition receiving zone 38*c*—the partition receiving zone 38*c* being located within the combined area of two adjacent interior side surfaces 30*c*, 32*c* of the outer case blank 20*c*. The first or primary partition blank 40*c* is attached, preferably via adhesive or glue, in a flat condition to a first side surface 30*c* of the outer case blank 20*c* via the divider panel contact region 44*c* and attached, preferably via adhesive or glue, to a second side surface 32*c* via a number of the cross member contact regions 50*c*. According to the illustrated embodiment, a second partition blank 40*c*' substantially identical to the first or primary partition blank 40*c* for forming a second partition member 14*c*' (FIG. 13) is similarly attached in a flat condition to a third side surface 34*c* of the outer case blank 20*c* via a number of the cross member contact regions 50*c* of the second partition blank 40*c*'; however, the second partition blank 40*c*' may alternatively be placed within the partition receiving zone 38*c* and/or attached to the first partition blank 40*c* for subsequent attachment to the third side surface 34*c* of the outer case blank 20*c* when the outer case blank 20*c* is folded, as described below.

With at least the first partition blank 40*c* in the partition receiving zone 38*c*, the outer case blank 20*c* may be folded about fold line a (FIG. 12B) and fold line b (FIG. 12C) to substantially enclose the first partition blank 40*c* and the second partition blank 40*c*' therein. When folding the outer case blank 20*c* in this manner the second partition blank 40*c*' is attached, preferably via adhesive or glue, to a fourth side surface 36*c* of the outer case blank 20*c*. Broken lines 45*c* in FIG. 12B illustrate where the fourth side surface 36*c* contacts the divider panel contact region 44*c* of the second partition blank 40*c*'. In addition, an end portion 54*c* of one or more of the cross members 46*c* of the first partition blank 40*c* may be attached to corresponding cross members 46*c* of the second partition blank 40*c*'. For example, as illustrated in FIG. 12A, the end portion 54*c* of each of two cross members 46*c* may attach to other corresponding cross members 46*c* at the location illustrated by broken lines 55*c*. In this manner, some cross members 46*c* are attached together to erect simultaneously when transitioning to the erected or expanded condition.

End side panels of the outer case blank 20*c* are secured together, preferably glued, via glue flap 26*c* as indicated by broken lines 27*c* in FIG. 12B to complete an erectable container structure 60*c* that is configured to erect or expand from a flat condition, wherein both of the first partition blank 40*c* and the second partition blank 40*c*' remain flat, to an expanded condition, wherein the first and the second partition blanks 40*c*, 40*c*' are erected to form partitioned cells—the first and the second partition blanks 40*c*, 40*c*' cooperating with each other to create the plurality of cells. In other words, the partition blanks 40*c*, 40*c*' are automatically and simultaneously erected with the outer case to partition the formed container into a plurality of cells.

Figure 13:
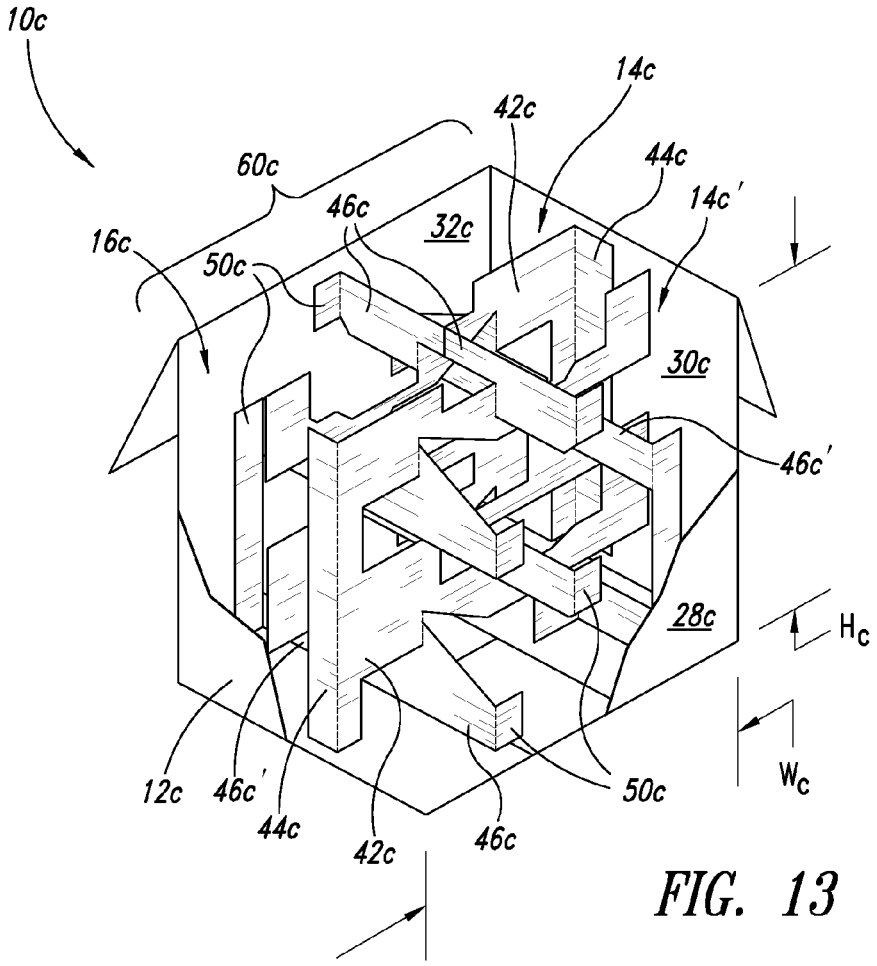
FIG. 13 is a partially cut-away perspective view of the outer case blank and the partition blanks of FIG. 12C in an expanded condition.
Figure 14:
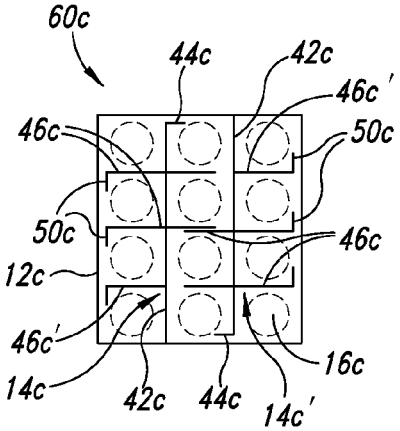
FIG. 14 is a top schematic view of the outer case blank and partition blanks of FIG. 12C in an expanded condition.

FIGS. 13 and 14 illustrate the erectable container structure 60*c* in the expanded condition with partitions 14*c*, 14*c*' shown dividing the outer case 12*c* into twelve cells 16*c*. As shown, at least some of the cross members 46*c* of the first or second partition 14*c*, 14*c*' attach to an interior surface of the outer case 12*c* and extend across the divider panel 42*c* of the first or second partition 14*c*, 14*c*' and terminate between the divider panel 42*c* of the first partition 14*c* and the divider panel 42*c* of the second partition 14*c*'. In this manner, end portions of some of the cross members 46*c* extend partially across the space between the divider panels 42*c* to form a number of the cells 16*c* and to prevent contact between adjacent articles in a reduced form that requires relatively less material than would otherwise be required of cross members that extend completely between divider panels. Other cross members 46*c*' of the first or second partition member 14*c*, 14*c*' attach to an interior surface of the outer case 12*c* and extend to and terminate at the divider panel 42*c*.

Although the illustrated embodiment includes five cross members 46*c*, 46*c*' on each partition 14*c*, 14*c*', more or fewer cross members may be used to partition the container 10*c*. For example, three cross members on each partition 14*c*, 14*c*' may be used to partition the container 10*c* into twelve cells. In addition, the cross members 46*c*, 46*c*' may be selectively located throughout the height Hc of the container 10*c* and may vary in size and shape to separate articles of various profiles and/or protect different areas of such articles.

Figure 15:
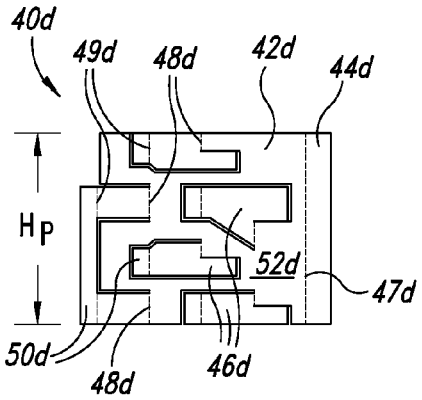
FIG. 15 is a plan view of a partition blank for forming a partition member according to one embodiment.

FIGS. 15 through 18 illustrate yet another embodiment of a partitioned container 10*d* for receiving and separating articles. As illustrated in FIG. 15, a secondary partition member is formed from a secondary unitary partition blank 40*d* preferably diecut from a single piece of paperboard having similar features to the first or primary partition blank 40*c* described above, such as a divider panel 42*d*, a divider panel contact region 44*d*, cross members 46*d*, cross member contact regions 50*d*, and corresponding rotation axes 47*d*, 48*d*, 49*d*.

Moreover, the secondary partition blank 40*d* has a partition surface 52*d* divided into contacting regions defined by those areas that are adapted to contact a surface of the container to be partitioned (i.e., the divider panel contact region 44*d* and the cross member contact regions 50*d*) and partitioning regions defined by those areas that are not adapted to contact the surface of the container (i.e., the divider panel 42*d* and the cross members 46*d*) when the container is erected. The partitioning regions of the partition surface 52*d* of the secondary partition blank 40*d* form an area which is equal to or less than an area of a primary side surface 28*d* (with reference to FIG. 17) of the container to be formed. Accordingly, when used in combination with the primary partition blank 40*c* of FIG. 11, a combined area of the partitioning regions of the partition surface 52*c* of the primary partition blank 40*c* and of the partition surface 52*d* of the secondary partition blank 40*d* is less than twice an area of the primary side surface 28*d* of the container 10*d* to be formed. The primary and secondary partition blanks 40*c*, 40*d* thereby cooperate to form an efficient partitioning structure in terms of material utilization.

In some embodiments, a height Hp of each of the primary and secondary partition blanks 40*c*, 40*d* is less than the height Hc of the container to be partitioned. Reducing the height Hp of each partition blank 40*c*, 40*d* leads to further reductions in the amount of material used to effectively partition a container and is therefore particularly advantageous for environmental impact reasons, as well as for reducing material costs.

Figure 16A:
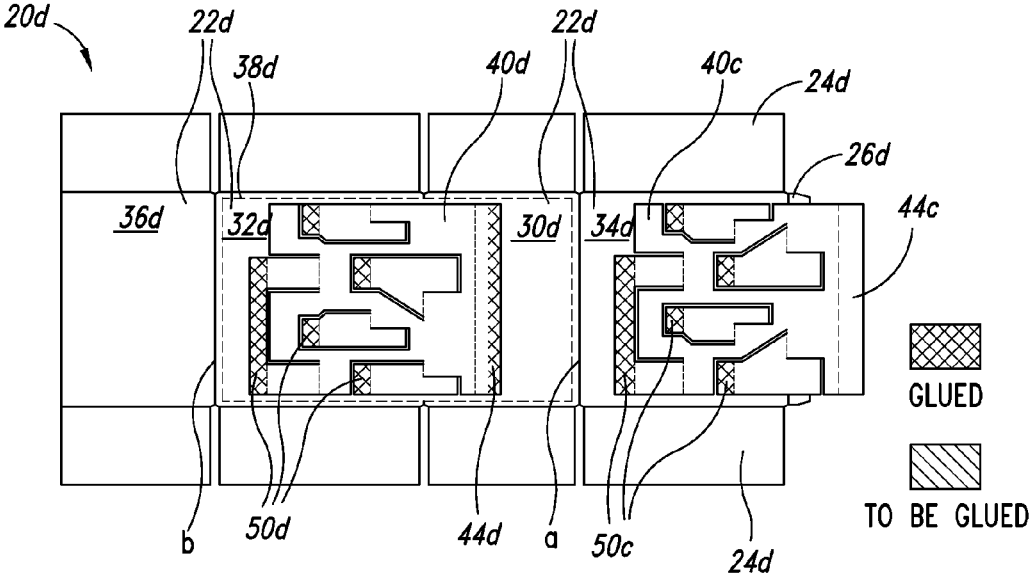
FIG. 16A is a plan view of an outer case blank for forming an outer case member with the partition blank of FIG. 11 and the partition blank of 15 attached thereto.
Figure 16B:
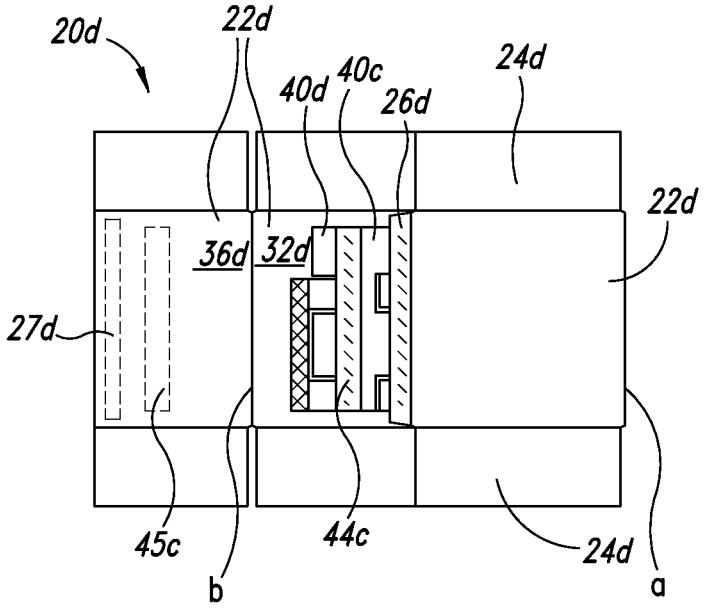
Figure 16C:
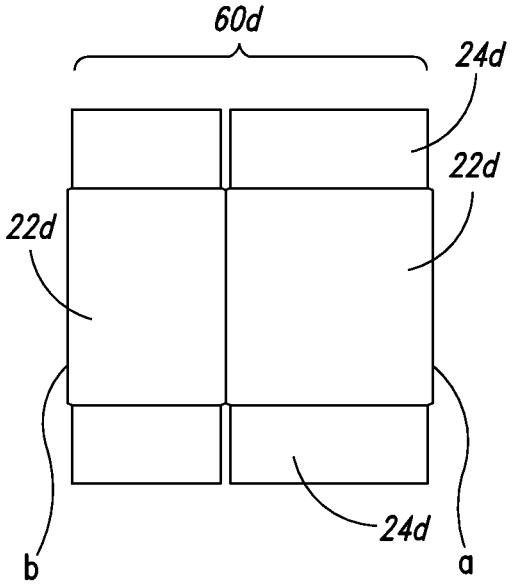
FIG. 16C is a plan view of the outer case blank and partition blanks of FIG. 16A folded about line a and line b.

With reference to FIGS. 16A-C, the secondary partition blank 40*d* is configured to attach to an outer case blank 20*d* (the outer case blank 20*d* comprising a conventional configuration including side panels 22*d*, top and bottom flaps 24*d* and a glue flap 26*d*) preferably within a partition receiving zone 38*d*—the partition receiving zone 38*d* being located within the combined area of two adjacent interior side surfaces 30*d*, 32*d* of the outer case blank 20*d*. The secondary partition blank 40*d* is attached, preferably via adhesive or glue, in a flat condition to a first side surface 30*d* of the outer case blank 20*d* via the divider panel contact region 44*d* and attached, preferably via adhesive or glue, to a second side surface 32*d* via a number of the cross member contact regions 50*d*. The primary partition blank 40*c* is similarly attached in a flat condition to a third side surface 34*d* of the outer case blank 20*d* via a number of the cross member contact regions 50*c*; however, the primary partition blank 40*c* may alternatively be placed within the partition receiving zone 38*d* for attachment to the third side surface 34*d* of the outer case blank 20*d* when the outer case blank 20*d* is subsequently folded, as described below.

With at least the secondary partition blank 40*d* in the partition receiving zone 38*d*, the outer case blank 20*d* may be folded about fold line a (FIG. 16B) and fold line b (FIG. 16C) to substantially enclose the primary partition blank 40*c* and the secondary partition blank 40*d* therein. When folding the outer case blank 20*d* in this manner the primary partition blank 40*c* is attached, preferably via adhesive or glue, to a fourth side surface 36*d* of the outer case blank 20*d*. Broken lines 45*c* in FIG. 16B illustrate where the fourth side surface 36*d* contacts the divider panel contact region 44*c* of the primary partition blank 40*c*. End side panels of the outer case blank 20*d* are secured together, preferably glued, via glue flap 26*d* as indicated by broken lines 27*d* in FIG. 16B to complete an erectable container structure 60*d* that is configured to erect or expand from a flat condition, wherein both of the primary partition blank 40*c* and the secondary partition blank 40*d* remain flat, to an expanded condition, wherein the primary and the secondary partition blanks 40*c*, 40*d* are erected to form partitioned cells—the primary and the secondary partition blanks 40*c*, 40*d* cooperating with each other to create the plurality of cells. In other words, the partition blanks 40*c*, 40*d* are automatically and simultaneously erected with the outer case to partition the formed container into a plurality of cells.

Figure 17:
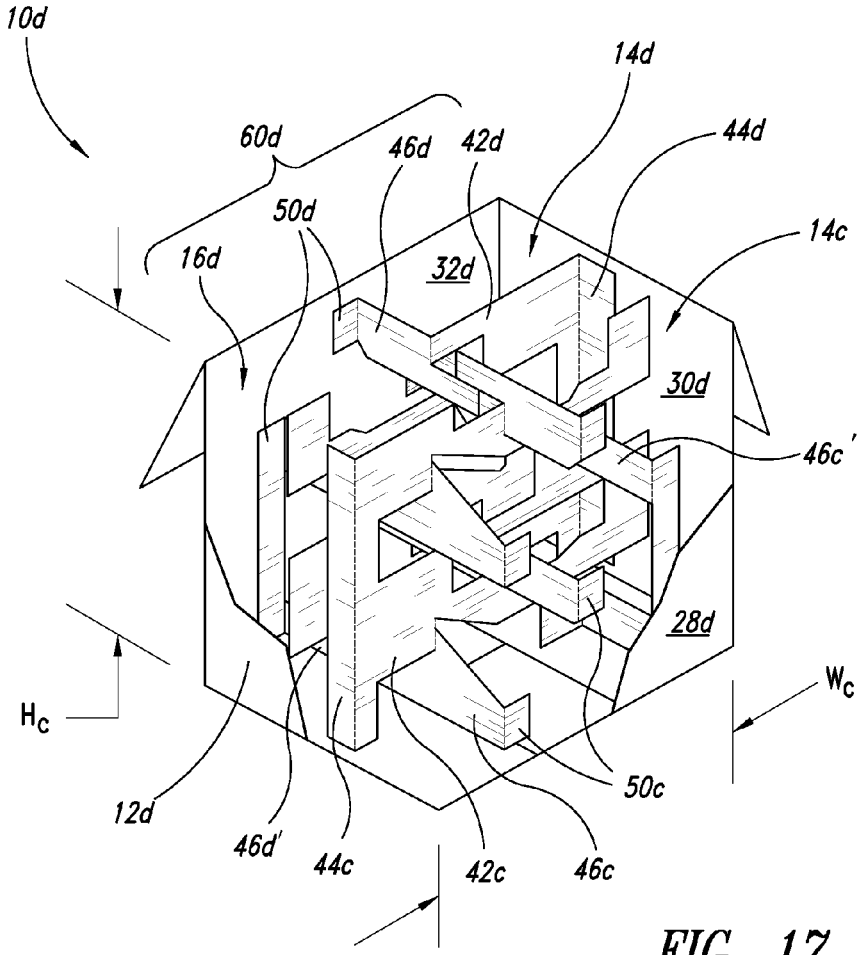
FIG. 17 is a partially cut-away perspective view of the outer case blank and the partition blanks of FIG. 16C in an expanded condition.
Figure 18:
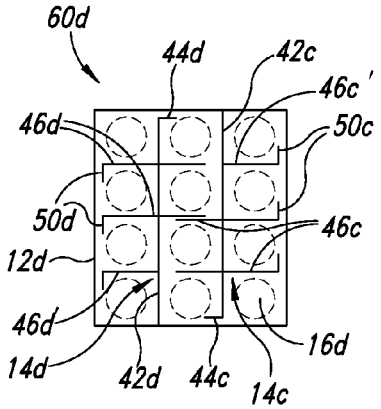
FIG. 18 is a top schematic view of the outer case blank and partition blanks of FIG. 16C in an expanded condition.

FIGS. 17 and 18 illustrate the erectable container structure 60*d* in the expanded condition with partitions 14*c*, 14*d* shown dividing the outer case 12*d* into twelve cells 16*d*. As shown, at least some of the cross members 46*c* of the primary partition 14*c* attach to an interior surface of the outer case 12*d* and extend across the divider panel 42*c* of the primary partition 14*c* and terminate between the divider panel 42*c* of the primary partition 14*c* and the divider panel 42*d* of the secondary partition 14*d*. In this manner, end portions of some of the cross members 46*c* extend partially across the space between the divider panels 42*c*, 42*d* to form a number of the cells 16*d* and to prevent contact between adjacent articles in a reduced form that requires relatively less material than would otherwise be required of cross members that extend completely between divider panels. Other cross members 46*c*' of the primary partition member 14*c* attach to an interior surface of the outer case 12*c* and extend to and terminate at the divider panel 42*c* of the primary partition member 14*c*. Similar characteristics apply to the cross members 46*d*, 46*d*' of the secondary partition 14*d*.

Although the illustrated embodiment includes five cross members 46*c*, 46*c*', 46*d*, 46*d*' on each partition 14*c*, 14*d*, more or fewer cross members may be used to partition the container 10*d*. For example, three cross members on each partition 14*c*, 14*d* may be used to partition the container 10*d* into twelve cells. In addition, the cross members 46*c*, 46*c*', 46*d*, 46*d*' may be selectively located throughout the height Hc of the container 10*d* and may vary in size and shape to separate articles of various profiles and/or protect different areas of such articles.

Figure 19:
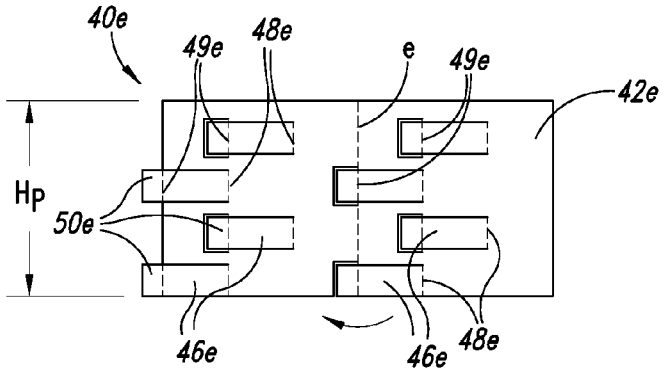
FIG. 19 is a plan view of a partition blank for forming a partition member according to one embodiment.
Figure 20:
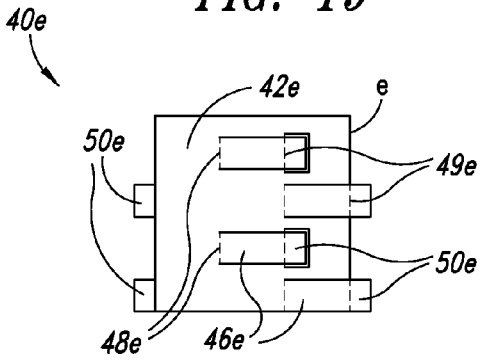
FIG. 20 is a plan view of the partition blank of FIG. 19 in a folded condition.

FIGS. 19 through 23 illustrate yet another embodiment of a partitioned container 10*e* for receiving and separating articles. As illustrated in FIGS. 19 and 20, a partition member for partitioning the container is formed from a unitary partition blank 40*e* preferably diecut from a single piece of paperboard having a divider panel 42*e* foldable about line e from an entirely flat condition (FIG. 19) to a substantially flat folded condition (FIG. 20). In the substantially flat folded condition, the divider panel 42*e* is adapted to divide a container into a number of rows.

The unitary partition blank 40*e* further includes a plurality of cross members 46*e*, wherein each cross member 46*e* is rotatably connected to a cross member contact region 50*e* for relative rotation therebetween about a contact region rotation axis 49*e*. Each cross member 46*e* is also rotatably connected to the divider panel 42*e* for rotation about a cross member rotation axis 48*e* from a flat condition (as shown in FIG. 20) to an erected or expanded condition. As the cross members 46*e* transition from the flat condition to the erected or expanded condition, the cross members 46*e* rotate relative to the divider panel 42*e* (about cross member rotation axes 48*e*) and the cross member contact regions 50*e* (about contact region rotation axes 49*e*) to subdivide rows created by the divider panel 42*e* into a plurality of cells for receiving and separating various articles. The cross member contact regions 50*e* are adapted to couple to interior surfaces of the container via glue or otherwise, thereby securing ends of the cross members 46*e* to side panels 22*e* of the partitioned container.

Similar to the earlier discussion, rotation of cross members 46*e* relative to the cross member contact regions 50*e* and relative to the divider panel 42*e* may be assisted by perforating, creasing, and/or scoring the partition blank 40*e* about each of the rotation axes 48*e*, 49*e*, as illustrated by broken lines in FIG. 19. In contrast, solid lines indicate where the partition blank 40*e* is cut or pierced through an entire thickness of the partition blank 40*e*. For example, apart from the cross member rotation axes 48*e*, the outer profile or contour of each cross member 46*e* and corresponding cross member contact region 50*e* is completely separated from surrounding material of the partition blank 40*e*.

In some embodiments, a height Hp of the foldable partition blank 40*e* is less than the height Hc of the container to be partitioned. Reducing the height Hp of the partition blank 40*e* leads to further reductions in the amount of material used to effectively partition a container and is therefore particularly advantageous for environmental impact reasons, as well as for reducing material costs.

Figure 21A:
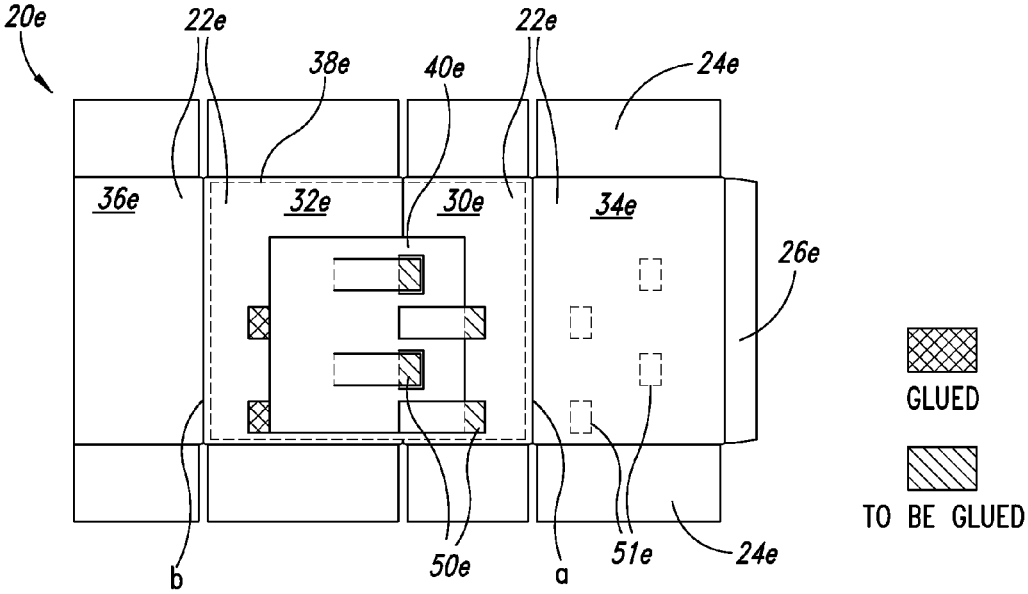
FIG. 21A is a plan view of an outer case blank for forming an outer case member with the folded partition blank of FIG. 20 attached thereto.
Figure 21B:
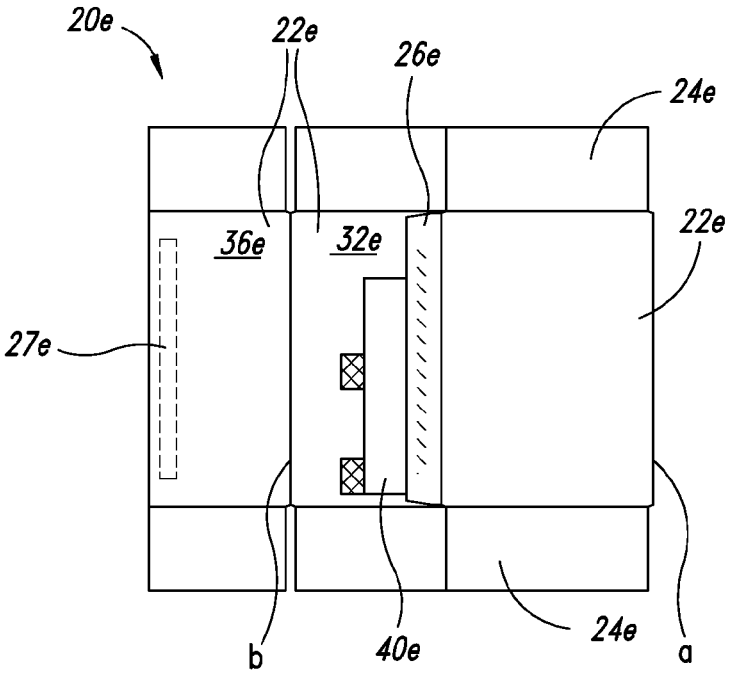
Figure 21C:
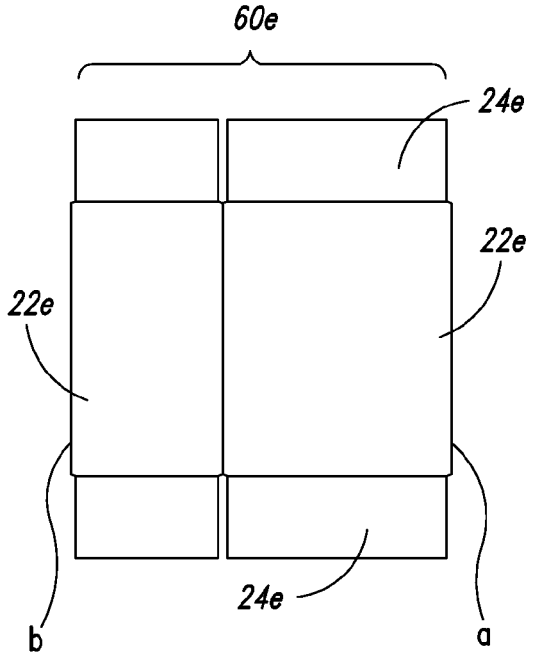
FIG. 21C is a plan view of the outer case blank and partition blank of FIG. 21A folded about line a and line b.

With reference to FIGS. 21A-C, the partition blank 40*e* is configured to attach to the outer case blank 20*e* (the outer case blank 20*e* comprising a conventional configuration including side panels 22*e*, top and bottom flaps 24*e* and a glue flap 26*e*) in the folded condition preferably within partition receiving zone 38*e*—the partition receiving zone 38*e* being located within the combined area of two adjacent interior side surfaces 30*e*, 32*e* of the outer case blank 20*e*. In this embodiment, the partition blank 40*e* is not configured to attach to the first side surface 30*e* of the outer case blank 20*e*, but is configured to attach, preferably via adhesive or glue, to the second side surface 32*e* via a number of the cross member contact regions 50*e*.

As shown in FIGS. 21A-C, with the partition blank 40*e* in the partition receiving zone 38*e*, the outer case blank 20*e* may be folded about fold line a (FIG. 21B) and fold line b (FIG. 21C) to substantially enclose the partition blank 40*e* therein. When folding the outer case blank 20*e* in this manner, the partition blank 40*e* is attached, preferably via adhesive or glue, to a third side surface 34*e* of the outer case blank 20*e*. Broken lines 51*e* in FIG. 21A illustrate where the third side surface 34*e* contacts cross member contact regions 50*e* of the partition blank 40*e*. End side panels of the outer case blank 20*e* are secured together, preferably glued, via glue flap 26*e* as indicated by broken lines 27*e* in FIG. 21B to complete an erectable container structure 60*e* that is configured to erect or expand from a flat condition, wherein the partition blank 40*e* remains substantially flat, to an expanded condition, wherein the partition blank 40*e* is erected to create partitioned cells. In this manner, the partition blank 40*e* is automatically and simultaneously erected with the outer case to partition the formed container into a plurality of cells.

Figure 22:
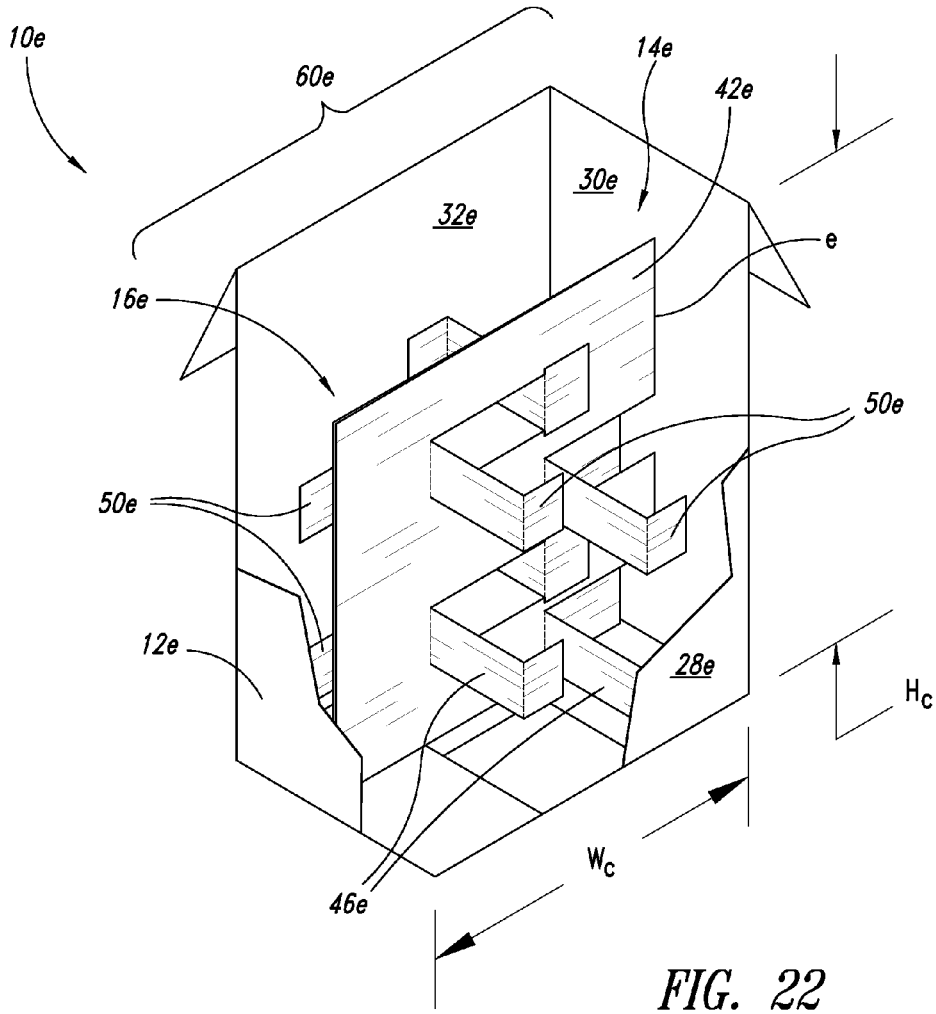
FIG. 22 is a partially cut-away perspective view of the outer case blank and partition blank of FIG. 21C in an expanded condition.
Figure 23:
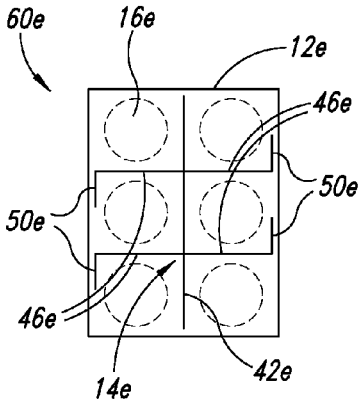
FIG. 23 is a top schematic view of the outer case blank and partition blank of FIG. 21C in an expanded condition.

FIGS. 22 and 23 illustrate the erectable container structure 60*e* in the expanded condition with the partition 14*e* shown dividing the outer case 12*e* into six cells 16*e*. As shown, the cross members 46*e* attach to an interior surface of the outer case 12*e* and extend to and terminate at the divider panel 42*e*.

Although the illustrated embodiment includes eight cross members 46*e*, more or fewer cross members 46*e* may be used to partition the container 10*e*. For example, four cross members 46*e* may be used to partition the container 10*e* into six cells. In addition, the cross members 46*e* may be selectively located throughout the height Hc of the container 10*e* and may vary in size and shape to separate articles of various profiles and/or protect different areas of such articles.

Figure 24:
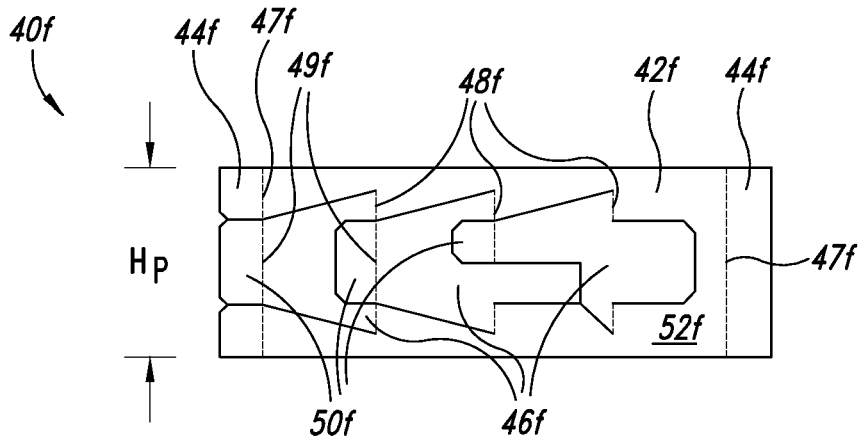
FIG. 24 is a plan view of a partition blank for forming a partition member according to one embodiment.

FIGS. 24 through 28 illustrate yet another embodiment of a partitioned container 10*f* for receiving and separating articles. As illustrated in FIG. 24, a first or primary partition member for partitioning the container is formed from a first or primary unitary partition blank 40*f* preferably diecut from a single piece of paperboard having a divider panel 42*f* and two or more divider panel contact regions 44*f*. The divider panel contact regions 44*f* are adapted to attach the divider panel 42*f* to interior surfaces of an outer case of the partitioned container, preferably via adhesive or glue. The divider panel contact regions 44*f* are also rotatably connected to the divider panel 42*f* about divider panel rotation axes 47*f* for rotation from a flat condition (as shown in FIG. 24) to an erected or expanded condition in which the divider panel 42*f* is substantially perpendicular to the divider panel contact regions 44*f*. Thus, in the erected or expanded condition, the divider panel 42*f* divides the container into a number of rows while the divider panel contact regions 44*f* secure the divider panel 42*f* to side panels of the container.

The first or primary unitary partition blank 40*f* further includes a plurality of cross members 46*f*, wherein each cross member 46*f* is rotatably connected to a cross member contact region 50*f* for relative rotation therebetween about a contact region rotation axis 49*f*. Each cross member 46*f* is also rotatably connected to the divider panel 42*f* for rotation about a cross member rotation axis 48*f* from a flat condition (as shown in FIG. 24) to an erected or expanded condition. As the cross members 46*f* transition from the flat condition to the erected or expanded condition, the cross members 46*f* rotate relative to the divider panel 42*f* (about cross member rotation axes 48*f*) and the cross member contact regions 50*f* (about contact region rotation axes 49*f*) to subdivide at least one row created by the divider panel 42*f* into a plurality of cells for receiving and separating various articles. The cross member contact regions 50*f* are adapted to couple to an interior surface of the container via glue or otherwise, thereby securing ends of the cross members 46*f* to a side panel 22*f* of the partitioned container.

Similar to the earlier discussion, rotation of cross members 46*f* relative to the cross member contact regions 50*f* and relative to the divider panel 42*f*, as well as rotation of the divider panel 42*f* relative to the divider panel contact regions 44*f*, may be assisted by perforating, creasing, and/or scoring the partition blank 40*f* about each of the rotation axes 47*f*, 48*f*, 49*f*, as illustrated by broken lines in FIG. 24. In contrast, solid lines indicate where the partition blank 40*f* is cut or pierced through an entire thickness of the partition blank 40*f*. For example, apart from the cross member rotation axes 48*f*, the outer profile or contour of each cross member 46*f* and corresponding cross member contact region 50*f* is completely separated from surrounding material of the partition blank 40*f*.

With reference to FIG. 24, the first or primary partition blank 40*f* has a partition surface 52*f* divided into contacting regions defined by those areas that are adapted to contact a surface of the container to be partitioned (i.e., the divider panel contact regions 44*f* and the cross member contact regions 50*f*) and partitioning regions defined by those areas that are not adapted to contact the surface of the container (i.e., the divider panel 42*f* and the cross members 46*f*) when the container is erected. The partitioning regions of the partition surface 52*f* of the first or primary partition blank 40*f* form an area which is equal to or less than an area of a primary side surface 28*f* (with reference to FIG. 27) of the container to be formed, and thus form an efficient partitioning structure in terms of material utilization.

Figure 25:
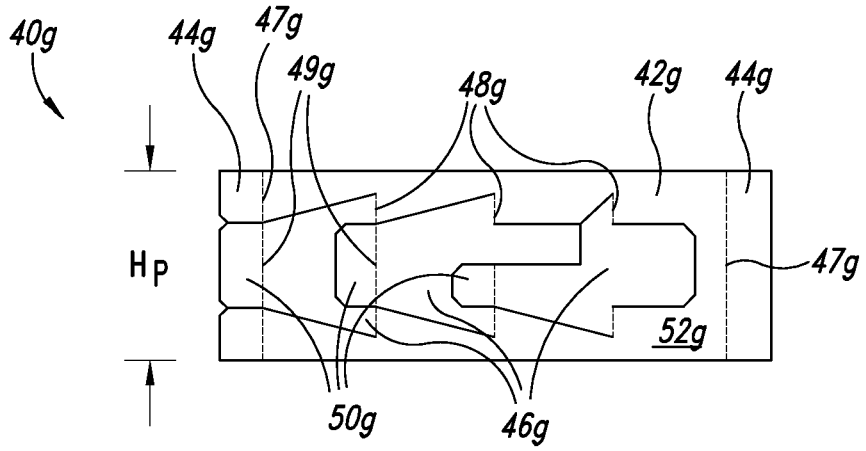
FIG. 25 is a plan view of a partition blank for forming a partition member according to one embodiment.

As illustrated in FIG. 25, a secondary partition member is formed from a secondary unitary partition blank 40*g* preferably diecut from a single piece of paperboard having similar features to the first or primary partition blank 40*f* described above, such as a divider panel 42*g*, divider panel contact regions 44*g*, cross members 46*g*, cross member contact regions 50*g*, and corresponding rotation axes 47*g*, 48*g*, 49*g*.

Moreover, the secondary partition blank 40*g* has a partition surface 52*g* divided into contacting regions defined by those areas that are adapted to contact a surface of the container to be partitioned (i.e., the divider panel contact regions 44*g* and the cross member contact regions 50*g*) and partitioning regions defined by those areas that are not adapted to contact the surface of the container (i.e., the divider panel 42*g* and the cross members 46*g*) when the container is erected. The partitioning regions of the partition surface 52*g* of the secondary partition blank 40*g* form an area which is equal to or less than an area of a primary side surface 28*f* (with reference to FIG. 27) of the container to be formed. Accordingly, when used in combination with the primary partition blank 40*f* of FIG. 24, a combined area of the partitioning regions of the partition surface 52*f* of the primary partition blank 40*f* and of the partition surface 52*g* of the secondary partition blank 40*g* is equal to or less than twice an area of the primary side surface 28*f* of the container 10*f* to be formed. The primary and secondary partition blanks 40*f*, 40*g* thereby cooperate to form an efficient partitioning structure in terms of material utilization.

In some embodiments, a height Hp of each of the primary and secondary partition blanks 40*f*, 40*g* is less than the height Hc of the container to be partitioned. Reducing the height Hp of each partition blank 40*f*, 40*g* leads to further reductions in the amount of material used to effectively partition a container and is therefore particularly advantageous for environmental impact reasons, as well as for reducing material costs.

Figure 26A:
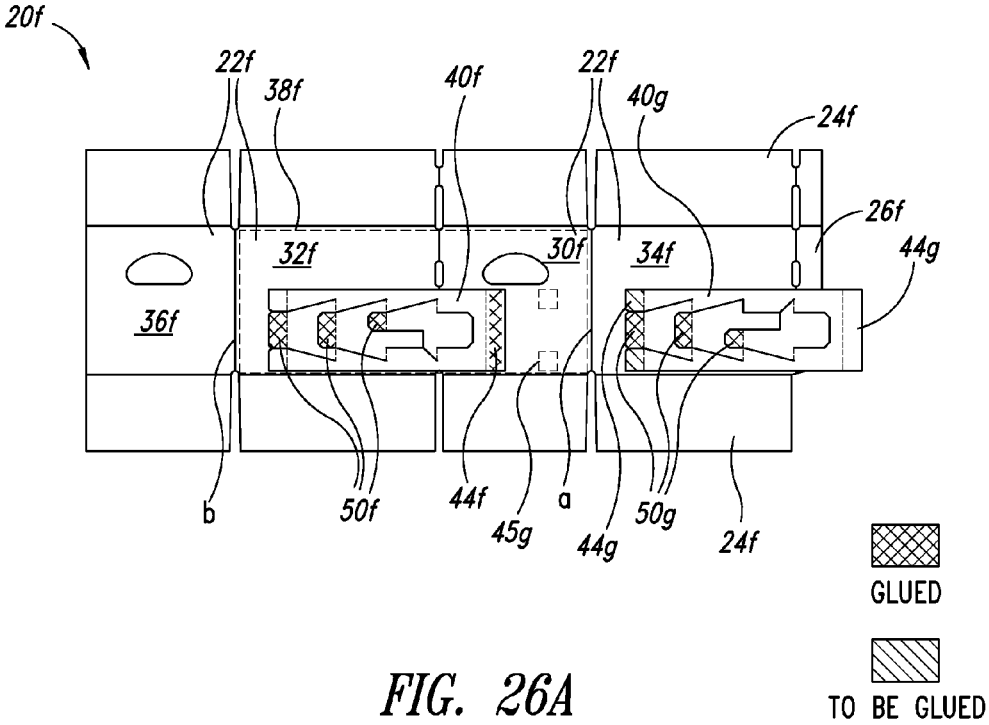
FIG. 26A is a plan view of an outer case blank for forming an outer case member with the partition blanks of FIGS. 24 and 25 attached thereto.
Figure 26B:
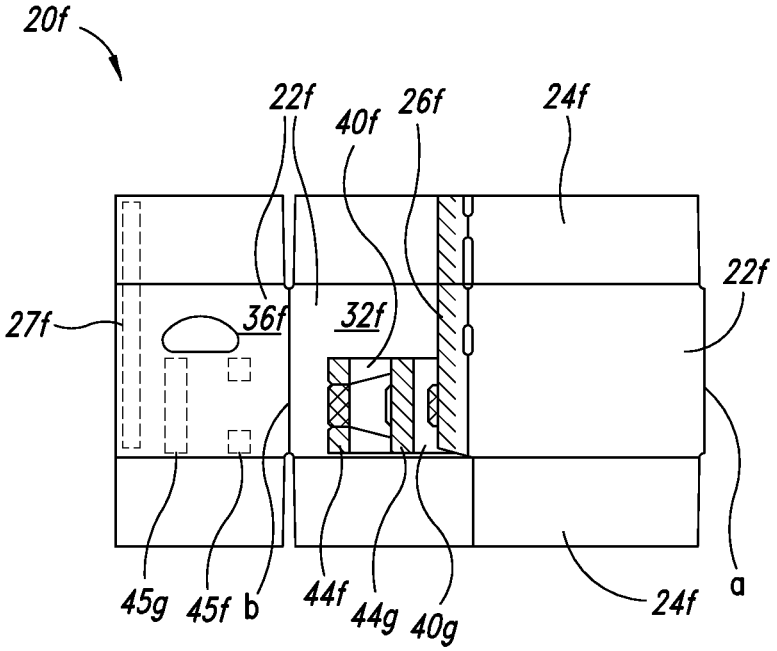
Figure 26C:
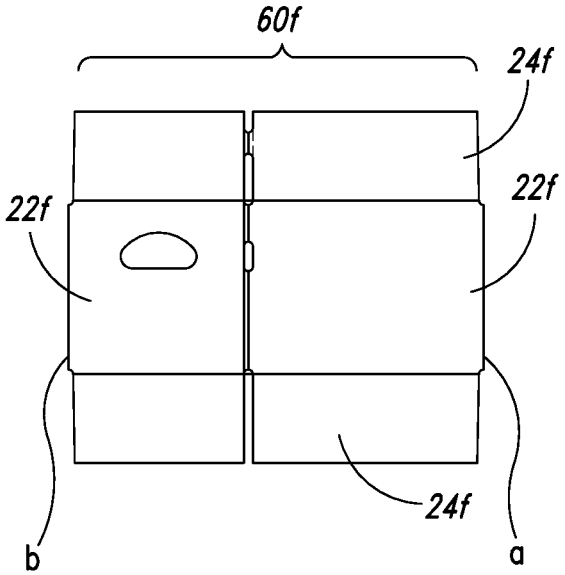
FIG. 26C is a plan view of the outer case blank and partition blanks of FIG. 26A folded about line a and line b.

With reference to FIGS. 26A-C, the first or primary partition blank 40*f* is configured to attach to an outer case blank 20*f* (the outer case blank 20*f* comprising a conventional configuration including side panels 22*f*, top and bottom flaps 24*f* and a glue flap 26*f*) preferably within a partition receiving zone 38*f*—the partition receiving zone 38*f* being located within the combined area of two adjacent interior side surfaces 30*f*, 32*f* of the outer case blank 20*f*. The first or primary partition blank 40*f* is attached, preferably via adhesive or glue, in a flat condition to a first side surface 30*f* of the outer case blank 20*f* via a divider panel contact region 44*f* and attached, preferably via adhesive or glue, to a second side surface 32*f* via a number of the cross member contact regions 50*f*. According to the illustrated embodiment, the secondary partition blank 40*g* is similarly attached in a flat condition to a third side surface 34*f* of the outer case blank 20*f* via a number of the cross member contact regions 50*g* of the secondary partition blank 40*g*; however, the secondary partition blank 40*g* may alternatively be placed within the partition receiving zone 38*f* and/or attached to the primary partition blank 40*f* for subsequent attachment to the third side surface 34*f* of the outer case blank 20*f* when the outer case blank 20*f* is folded, as described below.

With at least the primary partition blank 40*f* in the partition receiving zone 38*f*, the outer case blank 20*f* may be folded about fold line a (FIG. 26B) and fold line b (FIG. 26C) to substantially enclose the primary partition blank 40*f* and the secondary partition blank 40*g* therein. When folding the outer case blank 20*f* in this manner the primary partition blank 40*f* is attached, preferably via adhesive or glue, to a fourth side surface 36*f* of the outer case blank 20*f* and the secondary partition blank 40*g* is attached to the first side surface 30*f* and the fourth side surface 36*f* of the outer case blank 20*f*. Broken lines 45*g* in FIG. 26A illustrate where the first side surface 30*f* contacts divider panel contact regions 44*g* of the secondary partition blank 40*g* and broken lines 45*f* and 45*g* in FIG. 26B illustrate where the fourth side surface 36*f* contacts divider panel contact regions 44*f*, 44*g* of the primary and secondary partition blanks 40*f*, 40*g*, respectively.

End side panels of the outer case blank 20*f* are secured together, preferably glued, via glue flap 26*f* as indicated by broken lines 27*f* in FIG. 26B to complete an erectable container structure 60*f* that is configured to erect or expand from a flat condition, wherein both of the primary partition blank 40*f* and the secondary partition blank 40*g* remain flat, to an expanded condition, wherein the primary and the secondary partition blanks 40*f*, 40*g* are erected to form partitioned cells—the primary and the secondary partition blanks 40*f*, 40*g* cooperating with each other to create the plurality of cells. In other words, the partition blanks 40*f*, 40*g* are automatically and simultaneously erected with the outer case to partition the formed container into a plurality of cells.

Figure 27:
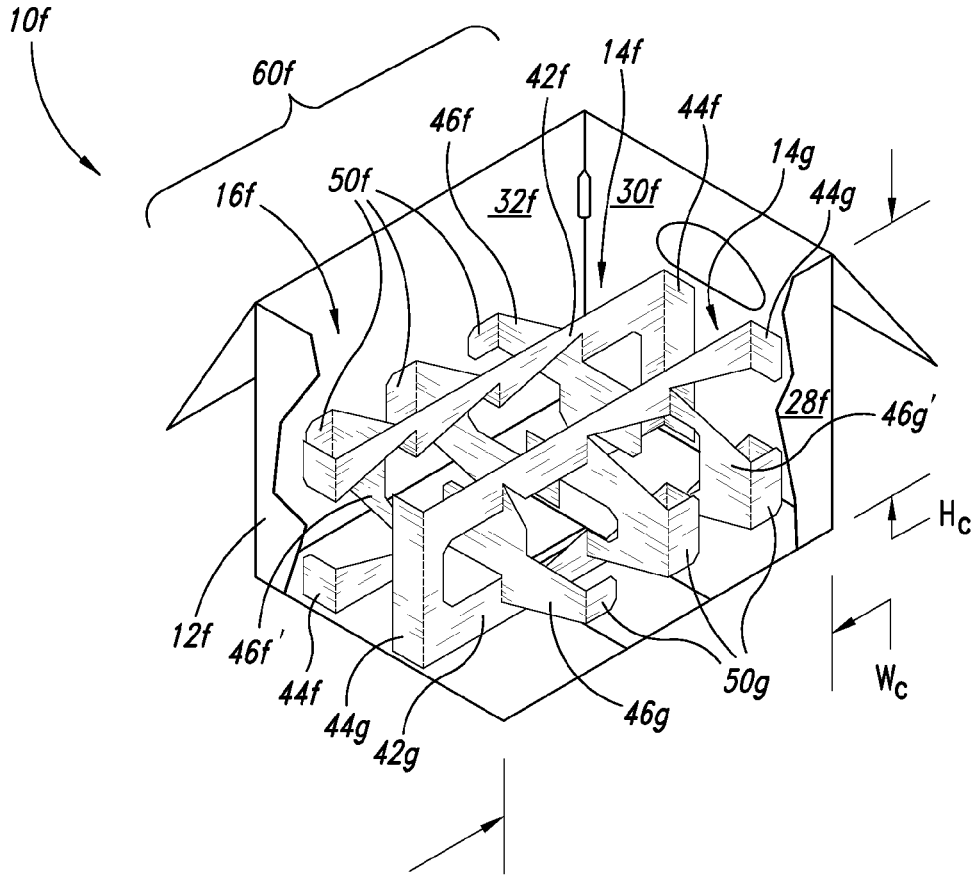
FIG. 27 is a partially cut-away perspective view of the outer case blank and the partition blanks of FIG. 26C in an expanded condition.
Figure 28:
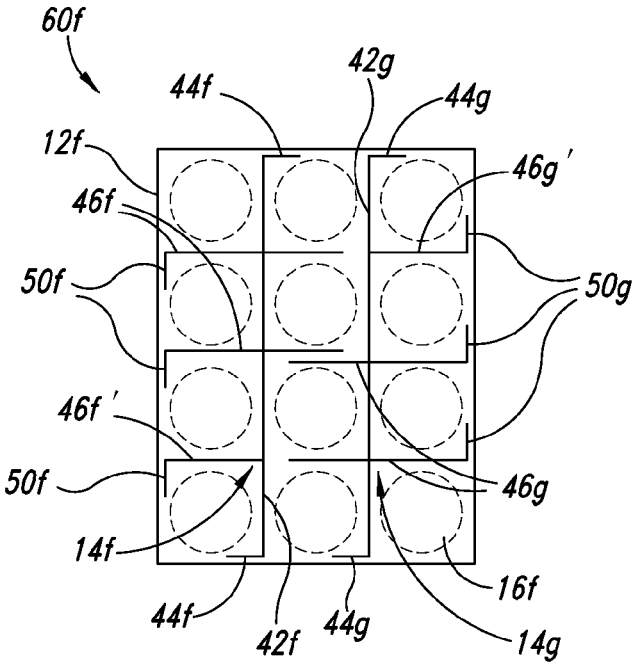
FIG. 28 is a top schematic view of the outer case blank and partition blanks of FIG. 26C in an expanded condition.

FIGS. 27 and 28 illustrate the erectable container structure 60*f* in the expanded condition with partitions 14*f*, 14*g* shown dividing the outer case 12*f* into twelve cells 16*f*. As shown, at least some of the cross members 46*f*, 46*g* of the primary and secondary partition 14*f*, 14*g* attach to an interior surface of the outer case 12*f* and extend across a divider panel 42*f*, 42*g* and terminate between the divider panel 42*f* of the primary partition 14*f* and the divider panel 42*g* of the secondary partition 14*g*. In this manner, end portions of some of the cross members 46*f*, 46*g* extend partially across the space between the divider panels 42*f* to form a number of the cells 16*f* and to prevent contact between adjacent articles in a reduced form that requires relatively less material than would otherwise be required of cross members that extend completely between divider panels. Other cross members 46*f*', 46*g*' of the primary and secondary partition member 14*f*, 14*g* attach to an interior surface of the outer case 12*f* and extend to and terminate at the divider panels 42*f*, 42*g*.

Although the illustrated embodiment includes three cross members 46*f*, 46*f*', 46*g*, 46*g*' on each partition 14*f*, 14*g*, more or fewer cross members may be used to partition the container 10*f*. For example, two cross members on each partition 14*f*, 14*g* may be used to partition the container 10*f* into nine cells. In addition, the cross members 46*f*, 46*f*', 46*g*, 46*g*' may be selectively located throughout the height Hc of the container 10*f* and may vary in size and shape to separate articles of various profiles and/or protect different areas of such articles.

A method for forming an erectable partitioned container according to one embodiment is described with reference to FIGS. 11 through 12C and begins where a first unitary partition blank 40*c* having a plurality of cross members 46*c* and one or more divider panels 42*c* is formed from raw stock material, such as, for example, paperboard, so that each cross member 46*c* is rotatably connected to the one or more divider panels 42*c* for rotation about a divider panel rotation axis 48*c* from a flat configuration or condition to an erected configuration or condition. The partition blank 40*c* is preferably formed via a diecutting process wherein profile edges defining the outer contours of the cross members 46*c* are formed by cutting completely through the sheet of paperboard and wherein perforated, creased and/or scored fold lines are formed at cross member rotation axes 48*c* for rotating the cross members 46*c* relative to the divider panel 42*c* and also at contact region rotation axes 49*c* for rotating the cross members 46*c* relative to cross member contact regions 50*c*. Likewise, additional perforated, creased and/or scored fold lines may be formed at divider panel rotation axes 47*c* to allow any panel divider contact regions 44*c* that may form part of the partition blank 40*c* to rotate relative to the one or more divider panels 42*c*.

In some embodiments, a second complementary partition blank 40*c*' having identical or similar features to the first partition blank 40*c* may be formed. In other embodiments, the first partition blank 40*c* is sufficient to effectively partition the interior of a container, and therefore forming a second partition blank 40*c*' is not required.

When forming the one or more partition blanks 40*c*, 40*c*', a variety of different size and shaped cross members and divider panels may be formed. In addition, partition blanks may erect or expand to separate a container into a differing number of cells, such as, for example, six, nine or twelve cells, depending on the configuration of the formed blank. The number of cross members and divider panels of the partition blanks may also vary.

For example, the partition blank 40*a* of FIG. 2 is configured to separate a container into six substantially equal cells using the six cross members 46*a* shown, however, a partition blank formed to include one divider panel and only two cross members can likewise divide a container into six substantially equal cells. As another example, the partition blank 40*b* of FIG. 6 is configured to separate a container into twelve substantially equal cells using the 12 cross members 46*b* shown, however, a partition blank formed to include two divider panels and only six cross members can likewise divide a container into twelve substantially equal cells. As yet another example, the partition blank 40*c* of FIG. 11 is configured to cooperate with an identical partition blank 40*c*' or a similar partition blank 40*d* (FIG. 15) to separate a container into twelve substantially equal cells using five cross members 46*c*, 46*d* on each partition, however, a pair of partition blanks each formed to include one divider panel and only three cross members can likewise divide a container into twelve substantially equal cells. As still yet another example, the foldable partition blank 40*e* of FIG. 19 is configured to separate a container into six substantially equal cells using the six cross members 46*e* shown, however, a foldable partition blank formed to include one divider panel and only four cross members can likewise divide a container into six substantially equal cells.

With reference again to FIGS. 11 through 12C, after forming the first partition blank 40*c*, a contact region 50*c* rotatably connected to at least one of the plurality of cross members 46*c* is attached to an interior surface 30*c*, 32*c* of an outer case blank 20*c*, the outer case blank 20*c* comprising a conventional configuration including side panels 22*c*, top and bottom flaps 24*c* and a glue flap 26*c*. Attachment to the outer case blank 20*c* is preferably carried out by applying a glue or adhesive, either by hand or by an automated process, to the outer case blank 20*c* and/or the portion of the partition blank 40*c* to be attached and then, with the partition blank 40*c* appropriately located, applying pressure to the combination of the partition blank 40*c* and outer case blank 20*c*. In some embodiments where the partition blank 40*c* includes one or more divider panel contact regions 44*c*, the one or more divider panel contact regions 44*c* may be attached in a similar manner to the first and/or a second interior surface 30c, 32c of the outer case blank 20c. In some embodiments that include more than one partition blank 40c, 40c', the second partition blank 40c' may be attached to the outer case blank 20c in a similar manner as the first partition blank 40c, or attached to the first partition blank 40c, prior to performing the folding steps discussed below.

Next, the outer case blank 20c is folded about fold line a and about fold line b to enclose the one or more partition blanks 40c, 40c' within the outer case blank 20c. When folding the outer case blank 20c in this manner, additional cross member contact regions 50c and/or divider panel contact regions 44c may be attached to a third interior surface 34c and/or a fourth interior surface 36c of the outer case blank 20c. For example, as illustrated in FIGS. 12B-C, the divider panel contact region 44c of the second partition blank 40c' is attached to the fourth interior surface 36c as the outer case blank 20c is folded about line b. Again, attachment is preferably carried out by applying a glue and/or adhesive to the outer case blank 20c and/or the portion of the partition blank 40c, 40c' to be attached. Also when folding the case blank 20c in this manner, the glue flap 26c of the outer case blank 20c is attached, preferably glued, to an end of the fourth interior surface 36c to complete an erectable partitioned container 60c—the erectable partitioned container 60c being configured, when the outer case is erected, to automatically and simultaneously erect or expand the one or more partitions 40c, 40c' attached therein. In other words, when the outer case blank 20c is erected in the conventional way, the one or more partition blanks 40c, 40c' attached therein are automatically erected or expanded to form a partitioned container. This automatic erecting of the partition member(s) conveniently reduces the complexity of and the time required for forming partitioned containers.

Although embodiments of the present invention have been described particularly with reference to partitioned containers having six or twelve cells, one of ordinary skill in the art will appreciate that the present invention is not limited in scope to partitioned containers having only twelve or six cells. For example, other embodiments may comprise an erectable container structure having one or more partition blanks adapted to form nine cells, for example, in three rows and three columns.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A partitioned container, comprising:

an outer case member erectable from a substantially flat condition to an expanded condition; and a partition structure including at least one partition formed from a unitary blank, the unitary blank being separate from the outer case member and configured to couple to at least one interior surface of the outer case member in the substantially flat condition, the unitary blank including a first divider panel having a plurality of cross members rotatably connected thereto and a second divider panel having a plurality of cross members rotatably connected thereto that are configured to automatically divide an interior of the outer case member into a plurality of cells when the outer case member is erected to the expanded condition, and the partition being configured such that an entirety of the first divider panel is an unfolded portion of the unitary blank and is unbonded to any other portion of the partition structure and such that an entirety of the second divider panel is an unfolded portion of the unitary blank and is unbonded to any other portion of the partition structure, wherein at least some of the plurality of cross members rotatably connected to the first divider panel extend from one side of the first divider panel, across the first divider panel and terminate between the first divider panel and the second divider panel when the outer case member is in the expanded condition, and wherein at least some of the plurality of cross members rotatably connected to the second divider panel extend from one side of the second divider panel, across the second divider panel and terminate between the first divider panel and the second divider panel when the outer case member is in the expanded condition.

2. A partitioned container, comprising:

an outer case member erectable from a substantially flat condition to an expanded condition; and a partition structure including at least one partition formed from a unitary blank, the unitary blank being separate from the outer case member and configured to couple to at least one interior surface of the outer case member in the substantially flat condition, the unitary blank including a first divider panel having a plurality of cross members rotatably connected thereto and a second divider panel having a plurality of cross members rotatably connected thereto that are configured to automatically divide an interior of the outer case member into a plurality of cells when the outer case member is erected to the expanded condition, wherein at least some of the plurality of cross members rotatably connected to the first divider panel extend from one side of the first divider panel, across the first divider panel and terminate between the first divider panel and the second divider panel when the outer case member is in the expanded condition, wherein at least some of the plurality of cross members rotatably connected to the second divider panel extend from one side of the second divider panel, across the second divider panel and terminate between the first divider panel and the second divider panel when the outer case member is in the expanded condition, and wherein the partition is configured to couple to the outer case member in the substantially flat condition with the partition in a condition in which the unitary blank is folded only about a single bend line.

3. A partitioned container, comprising:

an outer case member erectable from a substantially flat condition to an expanded condition; and a partition structure including at least one partition formed from a unitary blank, the unitary blank being separate from the outer case member and configured to couple to at least one interior surface of the outer case member in the substantially flat condition, the unitary blank including a first divider panel having a plurality of cross members rotatably connected thereto and a second divider panel having a plurality of cross members rotatably connected thereto that are configured to automatically divide an interior of the outer case member into a plurality of cells when the outer case member is erected to the expanded condition, wherein at least some of the plurality of cross members rotatably connected to the first divider panel extend from one side of the first divider panel, across the first divider panel and terminate between the first divider panel and the second divider panel when the outer case member is in the expanded condition, wherein at least some of the plurality of cross members rotatably connected to the second divider panel extend from one side of the second divider panel, across the second divider panel and terminate between the first divider panel and the second divider panel when the outer case member is in the expanded condition, and wherein the partition structure is formed entirely of the one partition and is adapted to divide the interior of the outer case member into twelve cells, and wherein the entire surface area of one side of the unitary blank in an entirely unfolded condition is less than twice the entire surface area of a primary side surface of the outer case member when disregarding areas of the unitary blank which are coupled to the outer case member.

4. A partitioned container, comprising:

an outer case member erectable from a substantially flat condition to an expanded condition; and a partition structure including at least one partition formed from a unitary blank, the unitary blank being separate from the outer case member and configured to couple to at least one interior surface of the outer case member in the substantially flat condition, the unitary blank including a first divider panel having a plurality of cross members rotatably connected thereto and a second divider panel having a plurality of cross members rotatably connected thereto that are configured to automatically divide an interior of the outer case member into a plurality of cells when the outer case member is erected to the expanded condition, wherein at least some of the plurality of cross members rotatably connected to the first divider panel extend from one side of the first divider panel, across the first divider panel and terminate between the first divider panel and the second divider panel when the outer case member is in the expanded condition, wherein at least some of the plurality of cross members rotatably connected to the second divider panel extend from one side of the second divider panel, across the second divider panel and terminate between the first divider panel and the second divider panel when the outer case member is in the expanded condition, and wherein the unitary blank bends from an entirely flat condition solely about substantially parallel bend lines to define the partition.

5. A partitioned container, comprising:

an outer case member erectable from a substantially flat condition to an expanded condition; and a partition structure including at least one partition formed from a unitary blank, the unitary blank being separate from the outer case member and configured to couple to at least one interior surface of the outer case member in the substantially flat condition, the unitary blank including a first divider panel having a plurality of cross members rotatably connected thereto and a second divider panel having a plurality of cross members rotatably connected thereto that are configured to automatically divide an interior of the outer case member into a plurality of cells when the outer case member is erected to the expanded condition, wherein at least some of the plurality of cross members rotatably connected to the first divider panel extend from one side of the first divider panel, across the first divider panel and terminate between the first divider panel and the second divider panel when the outer case member is in the expanded condition, wherein at least some of the plurality of cross members rotatably connected to the second divider panel extend from one side of the second divider panel, across the second divider panel and terminate between the first divider panel and the second divider panel when the outer case member is in the expanded condition, and wherein the first and second divider panels are integrally connected by an intermediate span that is coupled to an interior surface of the outer case member, and wherein the first and second divider panels and the plurality of cross members of each of the first and second divider panels are configured to automatically divide the interior of the outer case member into the plurality of cells when the outer case member is erected to the expanded condition.

6. The partitioned container of claim 5, wherein the first and second divider panels and the intermediate span define a u-shape when the outer case member is in the expanded condition, the first and second divider panels extending perpendicularly with respect to the intermediate span and parallel with respect to each other to divide the interior of the outer case member into three rows.

7. A partitioned container, comprising:

an outer case member erectable from a substantially flat condition to an expanded condition; and a partition structure including at least one partition formed from a unitary blank, the unitary blank being separate from the outer case member and configured to couple to at least one interior surface of the outer case member in the substantially flat condition, the unitary blank including a first divider panel having a plurality of cross members rotatably connected thereto and a second divider panel having a plurality of cross members rotatably connected thereto that are configured to automatically divide an interior of the outer case member into a plurality of cells when the outer case member is erected to the expanded condition, wherein at least some of the plurality of cross members rotatably connected to the first divider panel extend from one side of the first divider panel, across the first divider panel and terminate between the first divider panel and the second divider panel when the outer case member is in the expanded condition, wherein at least some of the plurality of cross members rotatably connected to the second divider panel extend from one side of the second divider panel, across the second divider panel and terminate between the first divider panel and the second divider panel when the outer case member is in the expanded condition, and wherein the unitary blank has an overall height in an entirely flat, unfolded condition equal to an overall height of the partition formed therefrom.

8. A partitioned container, comprising:

an outer case member erectable from a substantially flat condition to an expanded condition; and a partition structure including at least one partition formed from a unitary blank separate from the outer case member and configured to couple to at least one interior surface of the outer case member in the substantially flat condition, the unitary blank including a first divider panel having a plurality of cross members rotatably connected thereto and a second divider panel having a plurality of cross members rotatably connected thereto, the first and second divider panels being configured to automatically divide an interior of the outer case member into a plurality of rows and the plurality of cross members being configured to divide the interior of the outer case member into a plurality of columns when the outer case member is erected to the expanded condition, and the partition being configured such that every portion of the unitary blank that defines the first divider panel and the second divider panel is unfolded and unbonded to any other portion of the partition structure, wherein at least some of the plurality of cross members rotatably connected to the first divider panel extend from one side of the first divider panel, across the first divider panel and terminate between the first divider panel and the second divider panel when the outer case member is in the expanded condition, and wherein at least some of the plurality of cross members rotatably connected to the second divider panel extend from one side of the second divider panel, across the second divider panel and terminate between the first divider panel and the second divider panel when the outer case member is in the expanded condition.

9. A partitioned container, comprising:

an outer case member erectable from a substantially flat condition to an expanded condition; and a partition structure including at least one partition formed from a unitary blank separate from the outer case member and configured to couple to at least one interior surface of the outer case member in the substantially flat condition, the unitary blank including a first divider panel having a plurality of cross members rotatably connected thereto and a second divider panel having a plurality of cross members rotatably connected thereto, the first and second divider panels being configured to automatically divide an interior of the outer case member into a plurality of rows and the plurality of cross members being configured to divide the interior of the outer case member into a plurality of columns when the outer case member is erected to the expanded condition, wherein at least some of the plurality of cross members rotatably connected to the first divider panel extend from one side of the first divider panel, across the first divider panel and terminate between the first divider panel and the second divider panel when the outer case member is in the expanded condition, wherein at least some of the plurality of cross members rotatable connected to the second divider panel extend from one side of the second divider panel, across the second divider panel and terminate between the first divider panel and the second divider panel when the outer case member is in the expanded condition, and wherein the first and second divider panels are integrally connected by an intermediate span that is coupled to an interior surface of the outer case member, and wherein the first and second divider panels and the plurality of cross members of each of the first and second divider panels are configured to automatically divide the interior of the outer case member into a plurality of cells when the outer case member is erected to the expanded condition.

10. The partitioned container of claim 9, wherein the first and second divider panels and the intermediate span define a u-shape when the outer case member is in the expanded condition, the first and second divider panels extending perpendicularly with respect to the intermediate span and parallel with respect to each other to divide the interior of the outer case member into three rows.

* * * * *